US008360153B2

(12) United States Patent
Ford

(10) Patent No.: US 8,360,153 B2
(45) Date of Patent: Jan. 29, 2013

(54) DEBRIS-CATCHING ATTACHMENT DEVICE AND METHOD THEREFOR

(76) Inventor: Michael Brent Ford, St. George, UT (US)

( * ) Notice: Subject to any disclaimer, the term of this patent is extended or adjusted under 35 U.S.C. 154(b) by 266 days.

(21) Appl. No.: 12/840,512

(22) Filed: Jul. 21, 2010

(65) Prior Publication Data

US 2011/0024112 A1 Feb. 3, 2011

Related U.S. Application Data

(60) Provisional application No. 61/229,307, filed on Jul. 29, 2009.

(51) Int. Cl.
*E21B 37/00* (2006.01)

(52) U.S. Cl. ..... 166/311; 166/173

(58) Field of Classification Search ..... 166/311, 166/99, 173, 176
See application file for complete search history.

(56) References Cited

U.S. PATENT DOCUMENTS 4,971,148 A * 11/1990 Roche et al. ..... 166/88.1
6,464,010 B1 * 10/2002 Brown ..... 166/311
6,745,839 B1 * 6/2004 Simpson ..... 166/311
7,404,702 B2 * 7/2008 Ford ..... 417/430
7,712,520 B1 * 5/2010 Hettes ..... 166/173
2007/0068670 A1 * 3/2007 Booth ..... 166/173
2008/0245523 A1 * 10/2008 Potter ..... 166/173
2010/0096121 A1 * 4/2010 Hettes ..... 166/173

* cited by examiner

*Primary Examiner* — William P Neuder
(74) *Attorney, Agent, or Firm* — Weiss & Moy, P.C.; Jeffrey D. Moy

(57) ABSTRACT

A debris-catching attachment device and method therefor is disclosed. When positioned in wellbore tubing, the device collects solid impurities found in well environments, thereby preventing the solids from settling onto the pump and its components when pumping operations are halted. The device comprises a ring having one of a plurality of brushes and a plurality of wiper segments coupled to a surface of the ring. As fluid is being forced naturally upward or is pumped, it flows past the components of the ring and is caused to rotate or spin in a cyclonic motion. During the first phase of well production, this directs the fluid and solids toward the tubing wall, allowing gas to escape upward. During the second phase of production, solids are caused to move toward the wall of the tubing, allowing any water and oil to move upward to the surface, with the surface tension dragging the solids along the wall of the tubing. The solids may accumulate on the brushes or wiper segments when pumping operations are halted.

10 Claims, 22 Drawing Sheets

DEBRIS-CATCHING ATTACHMENT DEVICE AND METHOD THEREFOR

RELATED APPLICATION

This non-provisional application claims priority from U.S. Provisional Application Ser. No. 61/229,307 entitled DEBRIS-CATCHING ATTACHMENT DEVICE FOR A PUMPING SYSTEM that was filed on Jul. 29, 2009 in the name of the inventor of this non-provisional application and is hereby incorporated in its entirety.

FIELD OF THE INVENTION

The present invention relates generally to fluid pumping apparatuses and systems and, more particularly, to a debris-catching attachment device that is intended to protect pump components from damaging solid impurities.

BACKGROUND OF THE INVENTION

Sub-surface wells typically include a shaft that is lined with piping known as "casing." Into the casing is inserted piping known as "tubing." When a well is drilled, it is not yet determined what kind of production the well will give up or produce. Most wells will produce fluid and gas naturally through the tubing without the assistance of a mechanical pumping unit during the beginning phase of the life of the well. In this first phase of production, many wells produce high volumes of gas with fluid, the fluid typically consisting of oil, water, and solids entrained therein. The formation geology where the well production is in this first phase has substantial natural pressure built up over time. This natural pressure allows the production fluid to be pumped or produced to the surface naturally, without the assistance of a mechanical pumping unit. Eventually, the bottom-hole pressure of the well formation subsides to a lower pressure. When that occurs, the fluid that was once being produced by natural pressure can no longer be forced to the surface through the tubing. When this takes place, the weight of the well fluid being produced will prevent the gas from being produced, due to the hydrostatic pressure of the fluid being held in the tubing column. The pressure of this fluid on the well's geologic formation stops most of the remaining gas from entering the wellbore. When the well reaches this point in production, an artificial method is required in order to pump the fluid, and the well then enters the second phase of production.

Oil well pumping systems are well known in the art. Such systems are used to mechanically remove oil or other fluid from beneath the earth's surface, particularly when the natural pressure in an oil well has diminished. Generally, an oil well pumping system begins with an above-ground pumping unit, which may commonly be referred to as a "pumpjack," "nodding donkey," "horsehead pump," "beam pump," "sucker rod pump," and the like. The pumping unit creates a reciprocating (up and down) pumping action that moves the oil (or other substance being pumped) out of the ground and into a flow line, from which the oil is then taken to a storage tank or other such structure.

Below the ground, a shaft is lined with casing. Into the casing is inserted tubing. Inside the tubing is inserted a string of sucker rods, which ultimately is indirectly coupled at its north end to the above-ground pumping unit. The string of sucker rods is ultimately indirectly coupled at its south end to a subsurface or "down-hole" pump that is located at or near the fluid in the oil well. The subsurface pump has a number of basic components, including a barrel and a plunger. The plunger operates within the barrel, and the barrel, in turn, is positioned within the tubing. It is common for the barrel to include a standing valve and the plunger to include a traveling valve. The standing valve has a ball therein, the purpose of which is to regulate the passage of production fluid—which includes oil mixed with water and gas—from down-hole into the pump, allowing the pumped matter to be moved northward out of the system and into the flow line, while preventing the pumped matter from dropping back southward into the hole. Oil is permitted to pass through the standing valve and into the pump by the movement of the ball off its seat, and oil is prevented from dropping back into the hole by the seating of the ball. North of the standing valve, coupled to the sucker rods, is the traveling valve. The traveling valve regulates the passage of oil from within the pump northward in the direction of the flow line, while preventing the pumped oil from dropping back southward, in the direction of the standing valve and hole.

Actual movement of the pumped substance through the system will now be discussed. Oil is pumped from a hole through a series of downstrokes and upstrokes of the pump, which motion is imparted by the above-ground pumping unit. During the upstroke, formation pressure causes the ball in the standing valve to move upward, allowing the oil to pass through the standing valve and into the barrel of the oil pump. This oil will be held in place between the standing valve and the traveling valve. In the traveling valve, the ball is located in the seated position, held there by the pressure from the oil that has been previously pumped.

On the downstroke, the ball in the traveling valve unseats, permitting the oil that has passed through the standing valve to pass therethrough. Also during the downstroke, the ball in the standing valve seats, preventing pumped oil from moving back down into the hole. The process repeats itself again and again, with oil essentially being moved in stages from the hole, to above the standing valve and in the oil pump, to above the traveling valve and out of the oil pump. As the oil pump fills, the oil passes through the pump and into the tubing. As the tubing is filled, the oil passes into the flow line, and is then taken to the storage tank or other such structure.

There are a number of problems that are regularly encountered during fluid production operations. Fluid that is produced from the ground is generally impure, and includes solid impurities such as sand, pebbles, limestone, grit, iron sulfide, and other sediment and debris. Certain kinds of sub-surface fluids, such as heavy crude, tend to contain a relatively large amount of solids. During the first phase of well production, eventually, the natural pressure in the well diminishes. As this occurs, solids settle back into the wellbore, gas is not permitted to escape upward, and the fluid begins to accumulate, thereby reducing the natural production of fluid and gas.

With respect to fluid production through mechanical pumping systems, typically, when such pumping operations have stopped, the solid impurities entrained in the fluid being pumped begin to settle, and they settle onto the pumping components. For example, the tubing joints may become completely filled with solid impurities, leading to damage and eventual pump failure. In this regard, in typical pumping systems, oftentimes the bottom first through fourth tubing joints completely fill with solid impurities, creating a plug. Even if pump failure does not result, this plug will eventually prevent the pumped fluid from passing. The plug can also lead to rod failure, due to compression loading.

The present invention addresses these problems encountered in prior art pumping systems and provides other, related advantages.

SUMMARY OF THE INVENTION

In accordance with an embodiment of the present invention, a debris-catching attachment device for a pumping system is disclosed. The debris-catching attachment device comprises, in combination: a ring adapted to permit a rod string to pass through a portion thereof; and one of a plurality of brushes and a plurality of wiper segments coupled to an outer surface of the ring.

In accordance with another embodiment of the present invention, a debris-catching attachment device for a pumping system is disclosed. The debris-catching attachment device comprises, in combination: a ring adapted to permit a rod string to pass through a central portion thereof; and one of a plurality of brushes and a plurality of wiper segments coupled to a surface of the ring; wherein the debris-catching attachment device is adapted to be positioned within tubing of a pumping system.

In accordance with a further embodiment of the present invention, a method for directing fluid through wellbore tubing is disclosed. The method comprises the steps of: providing at least one debris-catching attachment device comprising, in combination: a ring adapted to permit a rod string to pass through a central portion thereof; and one of a plurality of brushes and a plurality of wiper segments coupled to a surface of the ring, wherein the one of a plurality of brushes and a plurality of wiper segments are positioned in a substantially spiraled configuration; wherein the debris-catching attachment device is adapted to be positioned within the tubing; positioning the debris-catching attachment device within the tubing; forcing fluid upward; wherein the fluid flows past the one of a plurality of brushes and plurality of wiper segments; directing the fluid toward a wall of the tubing; and causing solid impurities entrained in the fluid to accumulate on the one of a plurality of brushes and plurality of wiper segments.

DESCRIPTION OF THE PREFERRED EMBODIMENTS

Figure 1A:
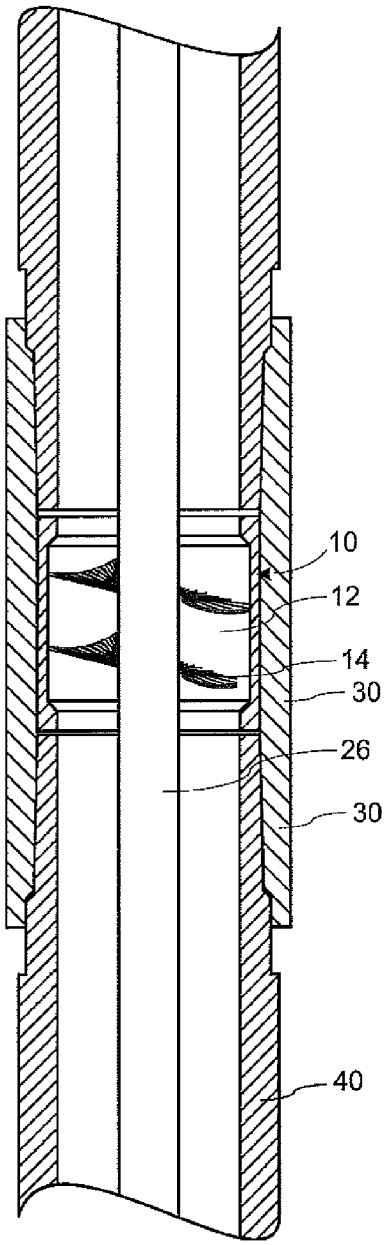
FIG. 1A is side, partially cutaway view of a debris-catching attachment device shown in position in a tubing collar of a pumping system, consistent with an embodiment of the present invention.
Figure 1B:
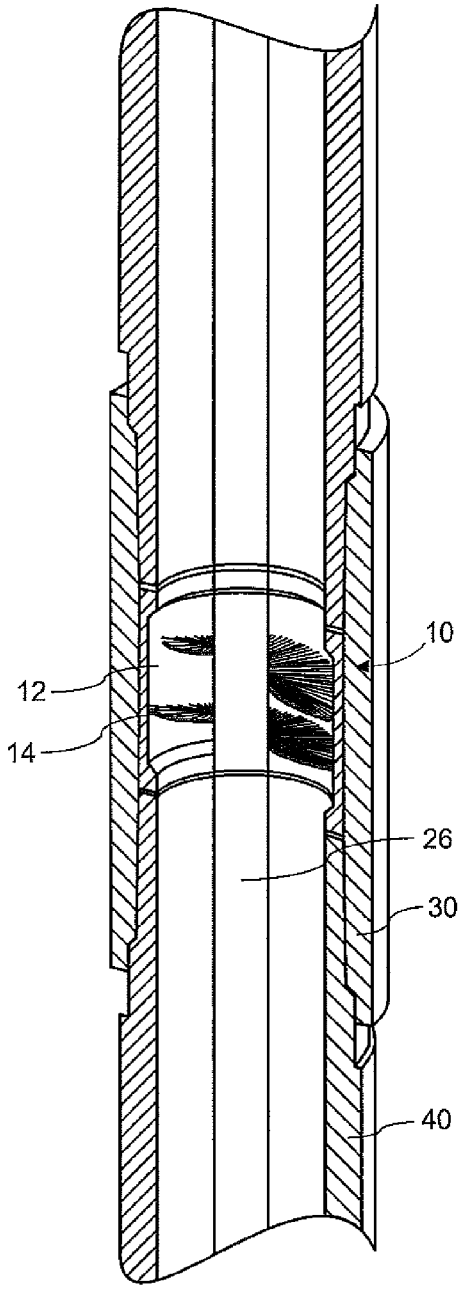
FIG. 1B is a perspective, partially cutaway view of the debris-catching attachment device of FIG. 1A.
Figure 1C:
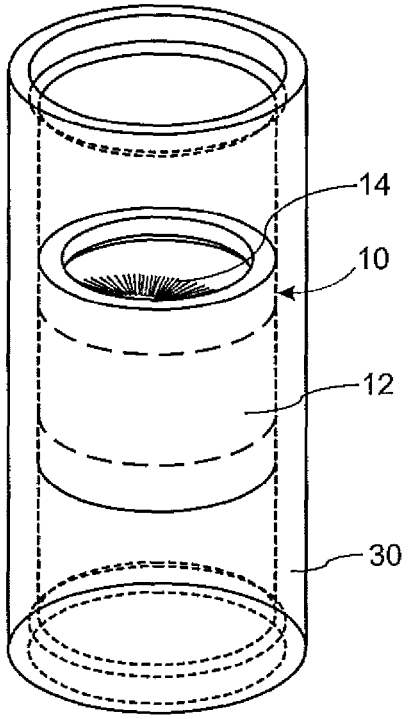
FIG. 1C is a perspective view of the debris-catching attachment device of FIG. 1A in position in a tubing collar, with the tubing collar shown in phantom.
Figure 1D:
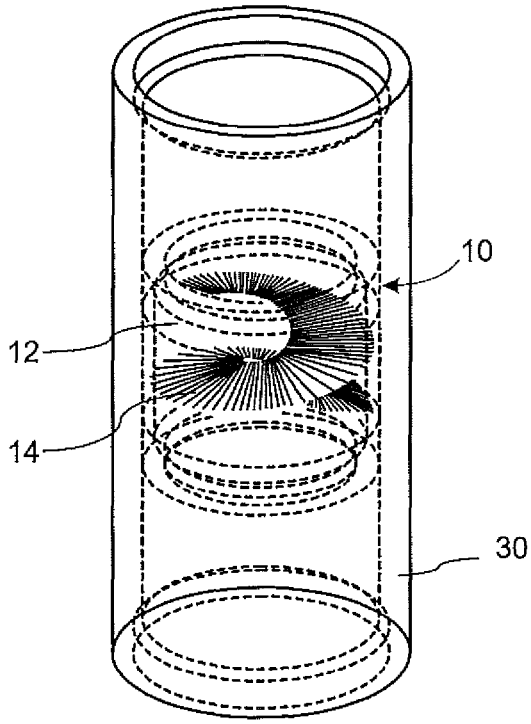
FIG. 1D is a perspective view of the debris-catching attachment device of FIG. 1C, with an outer ring thereof shown in phantom.
Figure 1E:
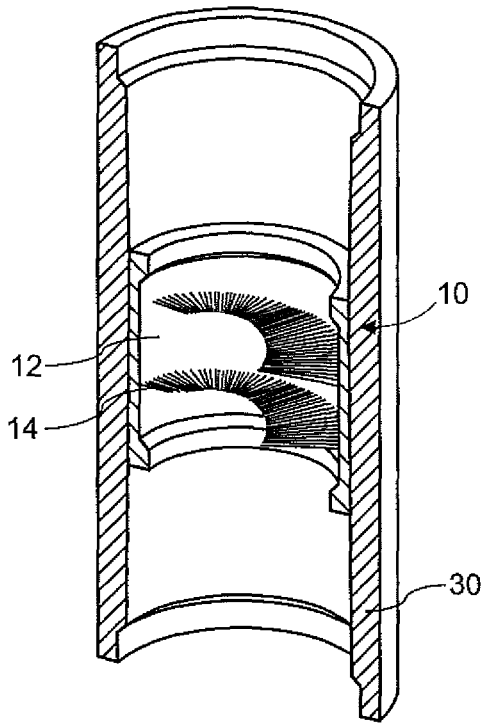
FIG. 1E is a perspective, cross-sectional view of the debris-catching attachment device of FIG. 1C.

Referring first to FIGS. 1A-1E, a debris-catching attachment device 10 consistent with an embodiment of the present invention is shown. The debris-catching attachment device 10 is adapted to be placed in a tubing collar 30 of a pumping system. The tubing collar 30, in turn, is shown in place on tubing 40 of a pumping system. The debris-catching attachment device 10 may be utilized during both the first and second phases of well production. The debris-catching attachment device 10 comprises an outer ring 12 with a plurality brushes 14 coupled thereto. A rod string 26 is permitted to pass through a central portion of the debris-catching attachment device 10. The debris-catching attachment device 10 may be configured as a one-piece unit or a multiple-piece unit, as desired. The outer ring 12 is preferably comprised of metal or some other durable material capable of withstanding conditions present in typical well environments.

The brushes 14, as shown in this embodiment, extend from an inner portion of the outer ring 12, and are inward-facing. In a preferred embodiment, the brushes 14 are arranged in a substantially spiraled configuration, as shown. However, the brushes 14 may be in a substantially flat configuration, a substantially spiraled configuration, or in a mixed configuration wherein some of the brushes 14 are substantially flat and some of the brushes 14 are substantially spiraled. With respect to materials used for the brushes 14, the brushes 14 may be comprised of an elastic material, a rubber material, or some other suitable material that is oil-resistant and capable of withstanding acid fluids and conditions present in typical well environments. It may be desired to form the brushes 14 from material that could be in a sheet form and then cut to fit a desired design for the brushes 14 and individual bristles thereon. Individual bristles on the brushes 14 may be shaped in a variety of ways; for example, they may be flat, round, square, and the like.

Figure 2:
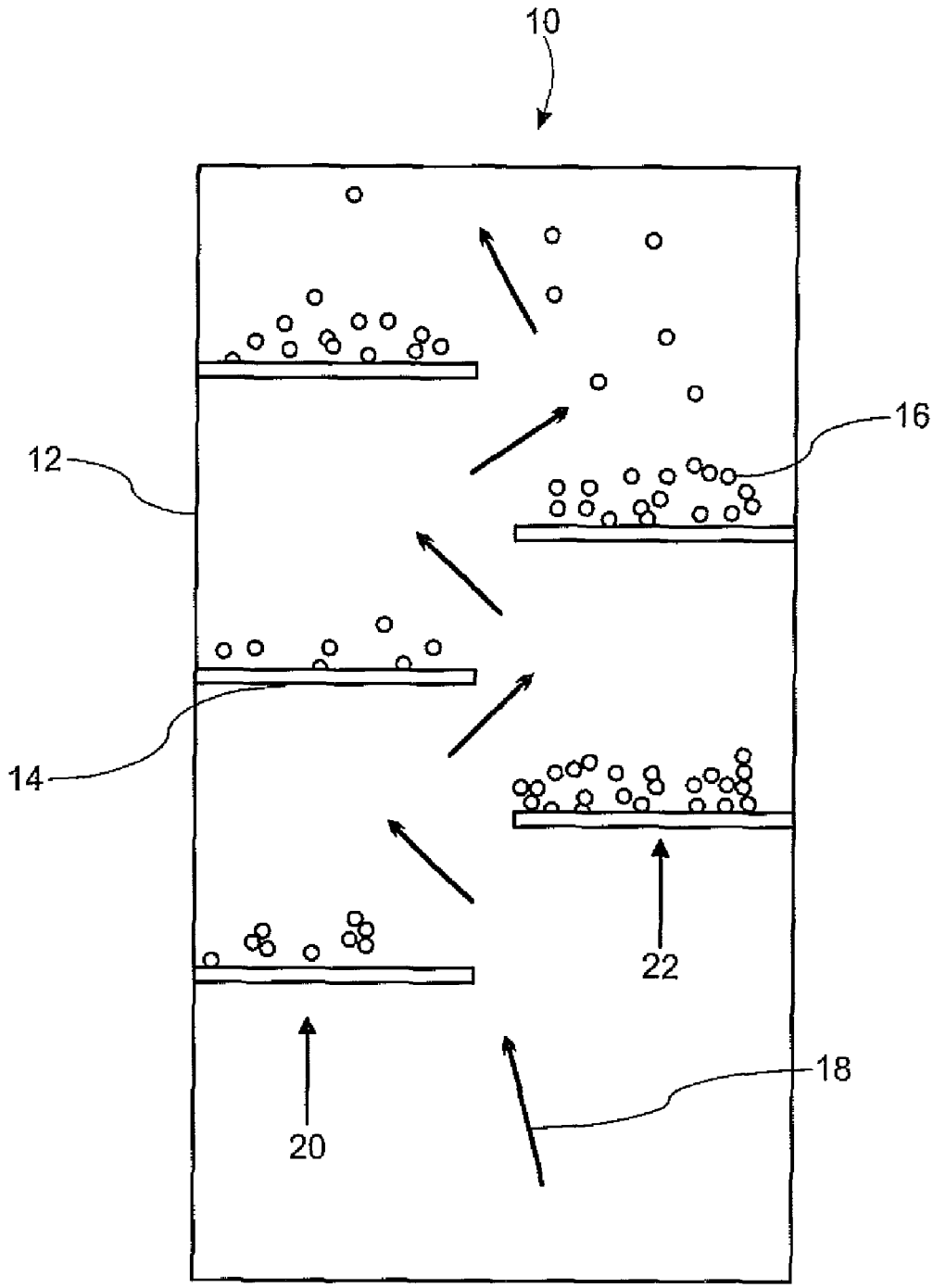
FIG. 2 is a side, cutaway view of a debris-catching attachment device, consistent with an embodiment of the present invention.
Figure 3A:
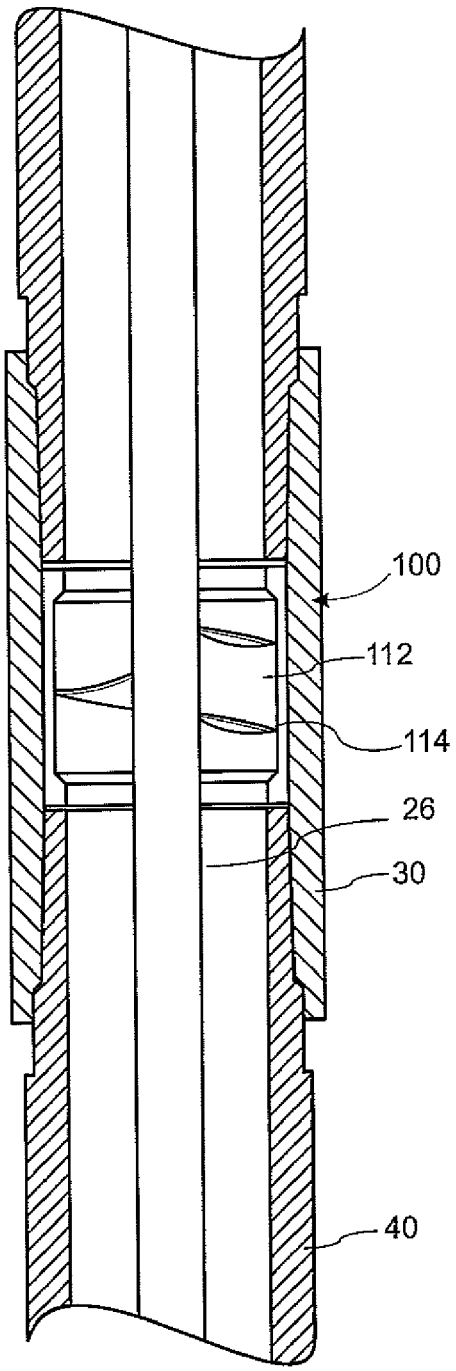
FIG. 3A is side, partially cutaway view of a debris-catching attachment device shown in position in a tubing collar of a pumping system, consistent with an embodiment of the present invention.
Figure 3B:
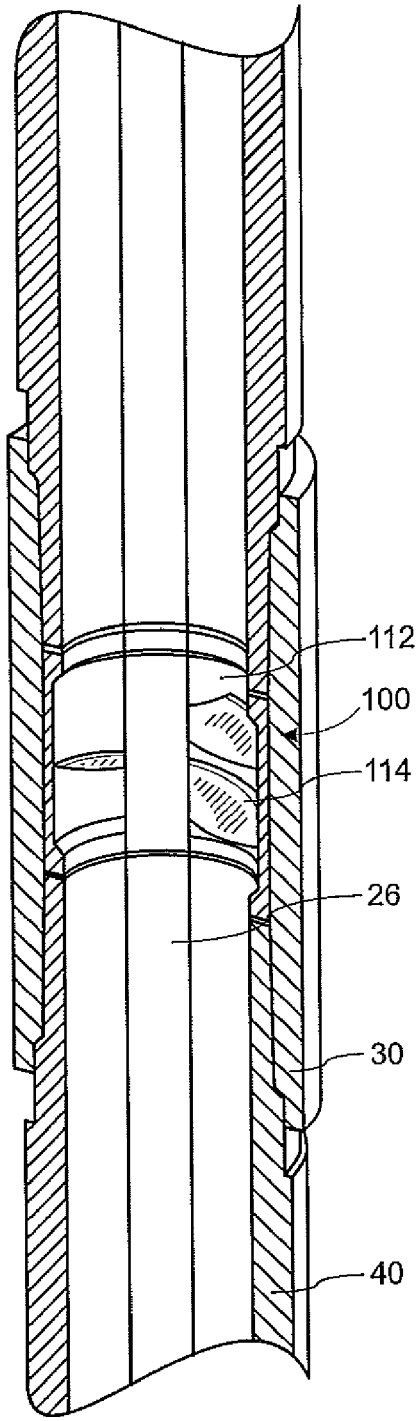
FIG. 3B is a perspective, partially cutaway view of the debris-catching attachment device of FIG. 3A.
Figure 3C:
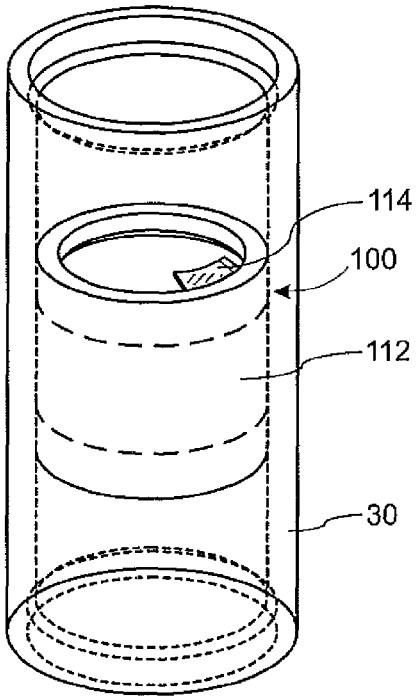
FIG. 3C is a perspective view of the debris-catching attachment device of FIG. 3A in position in a tubing collar, with the tubing collar shown in phantom.
Figure 3D:
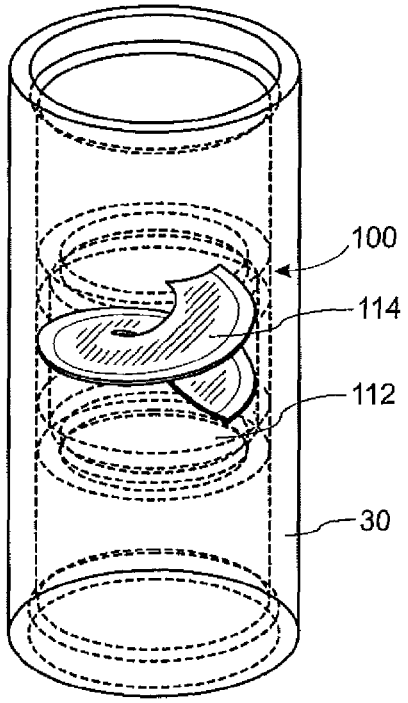
FIG. 3D is a perspective view of the debris-catching attachment device of FIG. 3C, with an outer ring thereof shown in phantom.
Figure 3E:
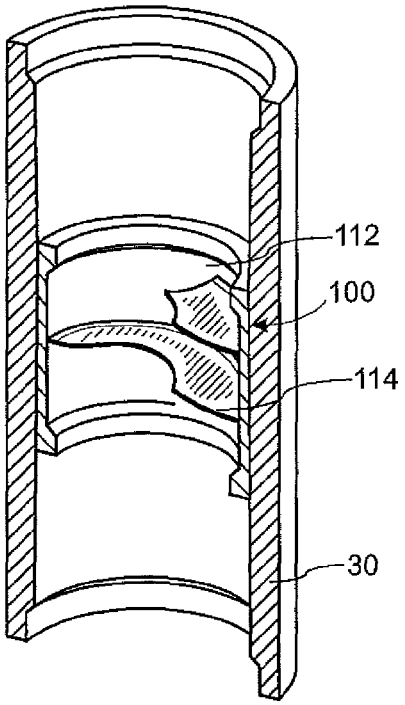
FIG. 3E is a perspective, cross-sectional view of the debris-catching attachment device of FIG. 3C.

Referring now to FIG. 2, another embodiment of a debris-catching attachment device 10 is shown, with the brushes 14 in a substantially flat configuration, as described above. As seen in this embodiment, it is preferred that when the brushes 14 are arranged in a substantially flat configuration, individual brushes 14 are spaced apart vertically and are offset from one another horizontally. As can be seen in this embodiment, the individual brushes 14 are segmented. For example, as shown in this embodiment, brushes 14 in a first column 20 are positioned opposite brushes 14 in a second column 22 with gaps therebetween. In this way, fluid 18 is permitted to flow around and through the brushes 14 when little or no solid impurities 16 are retained by the brushes 14, and the flow of fluid 18 is not blocked. As it is being pumped, fluid 18 is diverted to the gaps between the individual brushes 14.

Preferably, when the brushes 14 are positioned in a substantially spiraled configuration, the individual brushes 14 are spaced apart so as to allow fluid 18 to pass by without the flow of fluid 18 being restricted, but allowing solid impurities 16 to accumulate on the brushes 14 as they settle. Thus, the brushes 14, when in a spiraled configuration, create a vertical block for solid impurities 16, while allowing fluid 18 to flow. Brushes 14 positioned in a substantially spiraled configuration may be continuous with one another and placed on a continuous angle or may be segmented in a manner similar to the substantially flat configuration described above.

It should be noted that brushes 14 may be configured to cover various degrees in a horizontal plane, such as 180-degrees, 90-degrees, and the like. Tubing is typically round in design, having a 360-degree area in any given horizontal plane. Because of this, brushes 14 configured to cover 180-degrees in a horizontal plane, for example, may be positioned in the manner described above, with a first column 20 of brushes 14 positioned opposite brushes 14 in a second column 22 and offset from one another, while not restricting the flow of fluid 18. It may be desired to provide a debris-catching attachment device 10 in which the individual brushes 14 each cover the same degree areas in a horizontal plane, for example, 180-degrees. It may also be desired to provide a debris-catching attachment device 10 in which the individual brushes 14 each cover different degree areas in a horizontal plane, for example, with some brushes 14 covering 180-degrees and other brushes 14 covering 90-degrees, or variations thereof.

The debris-catching attachment device 10 provides multiple benefits. When utilized during the first phase of well production, the fluid that is forced naturally upward through the tubing 40 makes contact with the brushes 14. As this occurs, the spiraled configuration of the brushes 14 causes the fluid to rotate or spin in a cyclonic motion. As the fluid rotates cyclonically, the fluid and any solids entrained therein are swept toward the wall of the tubing 40, allowing any gas present to pass toward the center of the tubing 40. This cyclonic motion keeps the fluid and solids next to the wall of the tubing 40, allowing the gas to pass freely at a higher velocity, breaking the fluid particles up into smaller units, and sweeping out the well tubing 40 of liquid that would otherwise accumulate and create pressure within the wellbore and reduce the natural production of gas, fluid, and solids. Utilizing the debris-catching attachment device 10, the first phase of well production is extended. When the natural well pressure eventually drops, the solids will be captured on the brushes 14 and thereby prevented from falling back into the wellbore.

When utilized during the second phase of well production, the fluid that is being pumped upward through the tubing 40 makes contact with the brushes 14 of the debris-catching attachment device 10. As this occurs, the spiraled configuration of the brushes 14 causes the fluid to rotate or spin in a cyclonic motion. As the fluid rotates cyclonically, with the solids being naturally heavier than the fluid, the solids will move toward the wall of the tubing 40, allowing any water and oil to move upward to the surface, with the surface tension dragging the solids along the wall of the tubing 40.

When utilized during the second phase of well production, the debris-catching attachment device 10 also helps in preventing solid impurities, such as sand, pebbles, limestone, and other sediment and debris found in well environments, from settling onto the pump and its components when pumping operations are halted.

Preferably, a debris-catching attachment device 10 would be provided for each tubing joint of a pumping system. Utilizing multiple debris-catching attachment devices 10 allows the solids to be spread throughout the tubing column, thereby reducing the risk of blockage in tubing due to accumulation of the solids. Pumping units may be placed on time clocks and pump-off controllers that allow the units to stop during their pumping cycle, allowing fluid to refill the wellbore so that it may be pumped. In typical pumping systems, when pumping operations have stopped, solid impurities entrained in the fluid being pumped begin to settle, and they settle onto the pumping components. This can cause damage or failure of the pump. With the debris-catching attachment device 10 in place on the tubing joints, solid impurities will settle on top of the brushes 14. As a result, each tubing joint would have a relatively small column of settling solid impurities, as opposed to becoming completely filled with solid impurities and leading to eventual pump failure. In this regard, in typical pumping systems, oftentimes the bottom first through fourth tubing joints completely fill with solid impurities, creating a plug. Even if pump failure does not result, this plug will eventually prevent the pumped fluid from passing. The plug can also lead to rod failure, due to compression loading.

Referring now to FIGS. 3A-3E, another embodiment of a debris-catching attachment device, hereinafter debris-catching attachment device 100, is shown. The debris-catching attachment device 100 is adapted to be placed in a tubing collar 30 of a pumping system. The tubing collar 30, in turn, is shown in place on tubing 40 of a pumping system. The debris-catching attachment device 100 may be utilized during both the first and second phases of well production. The debris-catching attachment device 100 is similar to the debris-catching attachment device 10, but includes wiper segments 114 rather than brushes. The debris-catching attachment device 100 comprises an outer ring 112 with a plurality of wiper segments 114 coupled thereto. A rod string 26 is permitted to pass through a central portion of the debris-catching attachment device 100. The debris-catching attachment device 100 may be configured as a one-piece unit or a multiple-piece unit, as desired. The outer ring 112 is preferably comprised of metal or some other durable material capable of withstanding conditions present in typical well environments.

The wiper segments 114, as shown in this embodiment, extend from an inner portion of the outer ring 112, and are inward-facing. In a preferred embodiment, the wiper segments 114 are arranged in a substantially spiraled configuration. In other embodiments, the wiper segments may be arranged in a substantially flat configuration, or in a mixed configuration wherein a portion of the wiper segments 114 are substantially flat and a portion of the wiper segments 114 are substantially spiraled. The wiper segments 114 may be coupled to each other to form a one-piece unit. With respect to materials used for the wiper segments 114, the wiper segments 114 may be comprised of an elastic material, a rubber material, or some other suitable material that is oil-resistant and capable of withstanding acid fluids and conditions present in typical well environments. Instead of wiper segments 114, it may be desired to utilize a flat, wide bristle on the debris-catching device 100. It may be desired to form the wiper segments 114 from material that could be in a sheet form and then cut to fit a desired design for the wiper segments 114. The wiper segments 114 may be shaped in a variety of ways; for example, they may be flat, rounded, squared, and the like. The wiper segments 114 are preferably flexible and capable of moving in both an upward and downward direction.

When the wiper segments 114 of the debris-catching attachment device 100 are in a substantially flat configuration, as described above, it is preferred that the wiper segments 114 are spaced apart vertically and are offset from one another horizontally, in similar fashion to brushes 14 of the debris-catching attachment device 10, as shown in FIG. 2. In this way, fluid is permitted to flow around and through the wiper segments 114 when little or no solid impurities are retained by the wiper segments 114, and the flow of fluid is not blocked. As fluid is being pumped, it is diverted to the gaps between the wiper segments 114.

Preferably, when the wiper segments 114 are positioned in a substantially spiraled configuration, the wiper segments 114 are spaced apart so as to allow fluid to pass by without the flow of fluid being restricted, but allowing solid impurities to accumulate on the wiper segments 114 as they settle. Thus, the wiper segments 114, when in a spiraled configuration, create a vertical block for solid impurities, while allowing fluid to flow. The wiper segments 114 positioned in a substantially spiraled configuration may be continuous with one another and placed on a continuous angle or may be segmented in a manner similar to the substantially flat configuration described above.

It should be noted that wiper segments 114 may be configured to cover various degrees in a horizontal plane, such as 180-degrees, 90-degrees, and the like. It may be desired to provide a debris-catching attachment device 100 in which the wiper segments 114 each cover the same degree areas in a horizontal plane, for example, 180-degrees. It may also be desired to provide a debris-catching attachment device 100 in which the wiper segments 114 each cover different degree areas in a horizontal plane, for example, with some wiper segments 114 covering 180-degrees and other wiper segments 114 covering 90-degrees, or variations thereof.

The debris-catching attachment device 100 provides multiple benefits. When utilized during the first phase of well production, the fluid that is forced naturally upward through the tubing 40 makes contact with the wiper segments 114. As this occurs, the spiral orientation of the wiper segments 114 causes the fluid to rotate or spin in a cyclonic motion. As the fluid rotates cyclonically, the fluid and any solids entrained therein are swept toward the wall of the tubing 40, allowing any gas present to pass toward the center of the tubing 40. This cyclonic motion keeps the fluid and solids next to the wall of the tubing 40, allowing the gas to pass freely at a higher velocity, breaking the fluid particles up into smaller units, and sweeping out the well tubing 40 of liquid that would otherwise accumulate and create pressure within the wellbore and reduce the natural production of gas, fluid, and solids. Utilizing the debris-catching attachment device 100, the first phase of well production is extended. When the natural well pressure eventually drops, the solids will be captured on the wiper segments 114 and thereby prevented from falling back into the wellbore.

When utilized during the second phase of well production, the fluid that is being pumped upward through the tubing 40 makes contact with the wiper segments 114 of the debris-catching attachment device 100. As this occurs, the spiral orientation of the wiper segments 114 causes the fluid to rotate or spin in a cyclonic motion. As the fluid rotates cyclonically, with the solids being naturally heavier than the fluid, the solids will move toward the wall of the tubing 40, allowing any water and oil to move upward to the surface, with the surface tension dragging the solids along the wall of the tubing 40.

When utilized during the second phase of well production, the debris-catching attachment device 100 also helps in preventing solid impurities, such as sand, pebbles, limestone, and other sediment and debris found in well environments, from settling onto the pump and its components when pumping operations are halted, thereby protecting the pump components. Preferably, a debris-catching attachment device 100 would be provided for each tubing joint of a pumping system.

Referring now to FIGS. 4-6 and 7-9, additional embodiments of a debris-catching attachment device, hereinafter debris-catching attachment device 200, consistent with an embodiment of the present invention are shown positioned within tubing 130 in a pump barrel 140. The debris-catching attachment device 200 is adapted to be positioned around a rod string 216. The debris-catching attachment device 200 comprises an inner ring 212 with a plurality of brushes 214 coupled thereto. An opening 220 in the debris-catching attachment device 200 (shown in FIGS. 5 and 6, for example) permits the rod string 216 to pass therethrough, and is preferably adapted to correspond to an opening in a rod guide 218.

The inner ring 212 is preferably comprised of metal or some other durable material capable of withstanding conditions present in typical well environments. Preferably, the inner ring 212 is substantially cylindrical in shape, as shown in this embodiment, but may take on various other shapes. The inner ring 212, as shown in this embodiment, may be adapted to be coupled to rod guide 218. It may be desired to removably couple the debris-catching attachment device 200 to the rod guide 218 by some suitable means, such as threading. Alternatively, it may be desired to form the rod guide 218 and debris-catching attachment device 200 as a one-piece unit.

Figure 4:
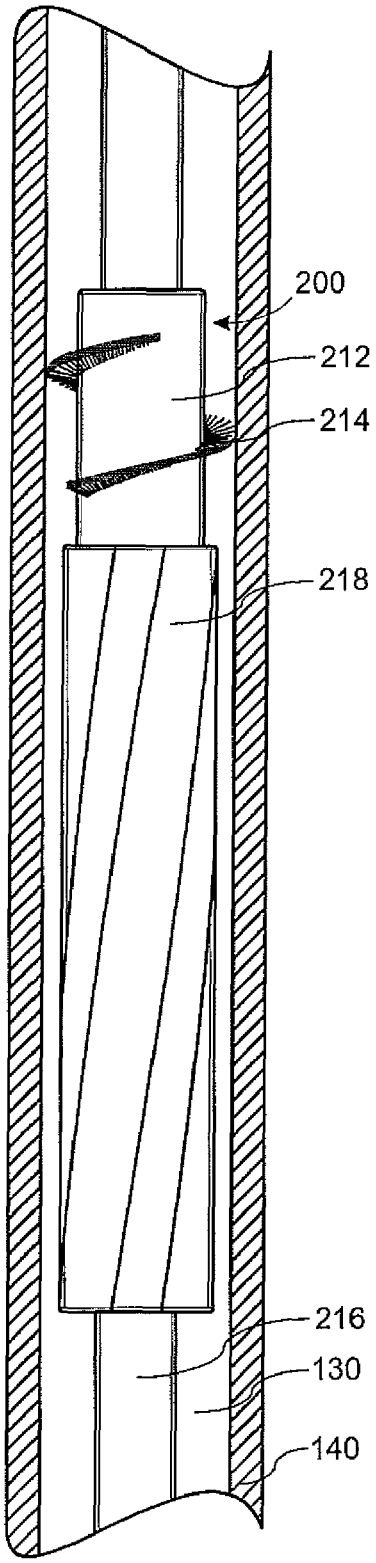
FIG. 4 is a side view of a debris-catching attachment device shown in position on a rod string, consistent with an embodiment of the present invention.
Figure 5:
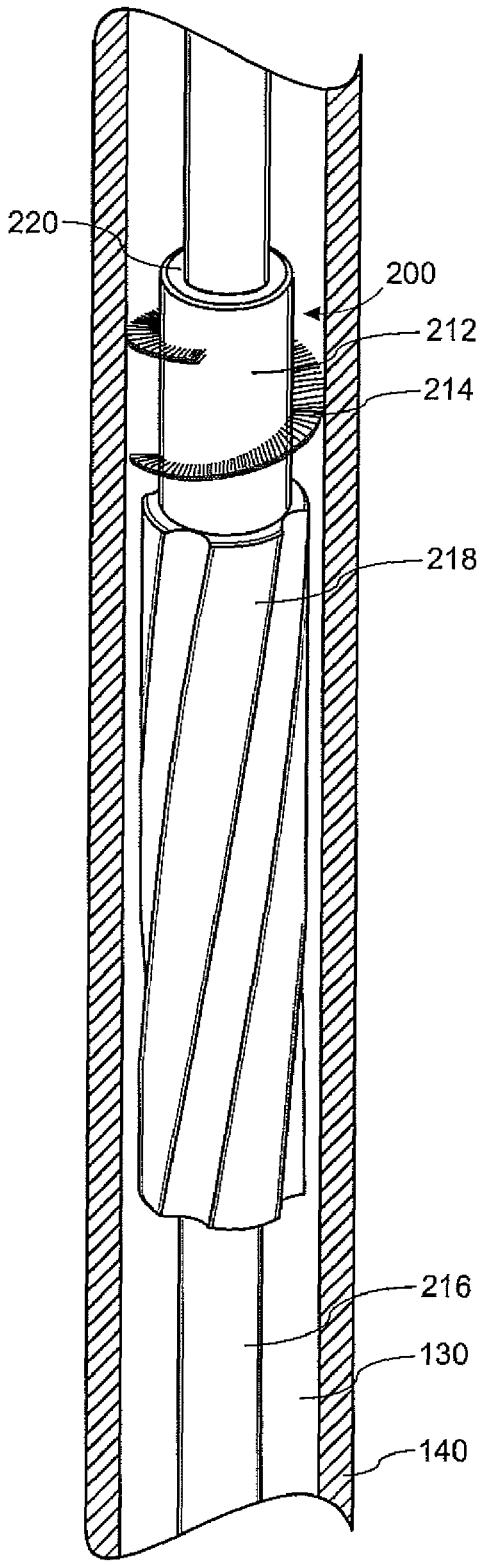
FIG. 5 is a perspective view of the debris-catching attachment device of FIG. 4.
Figure 6:
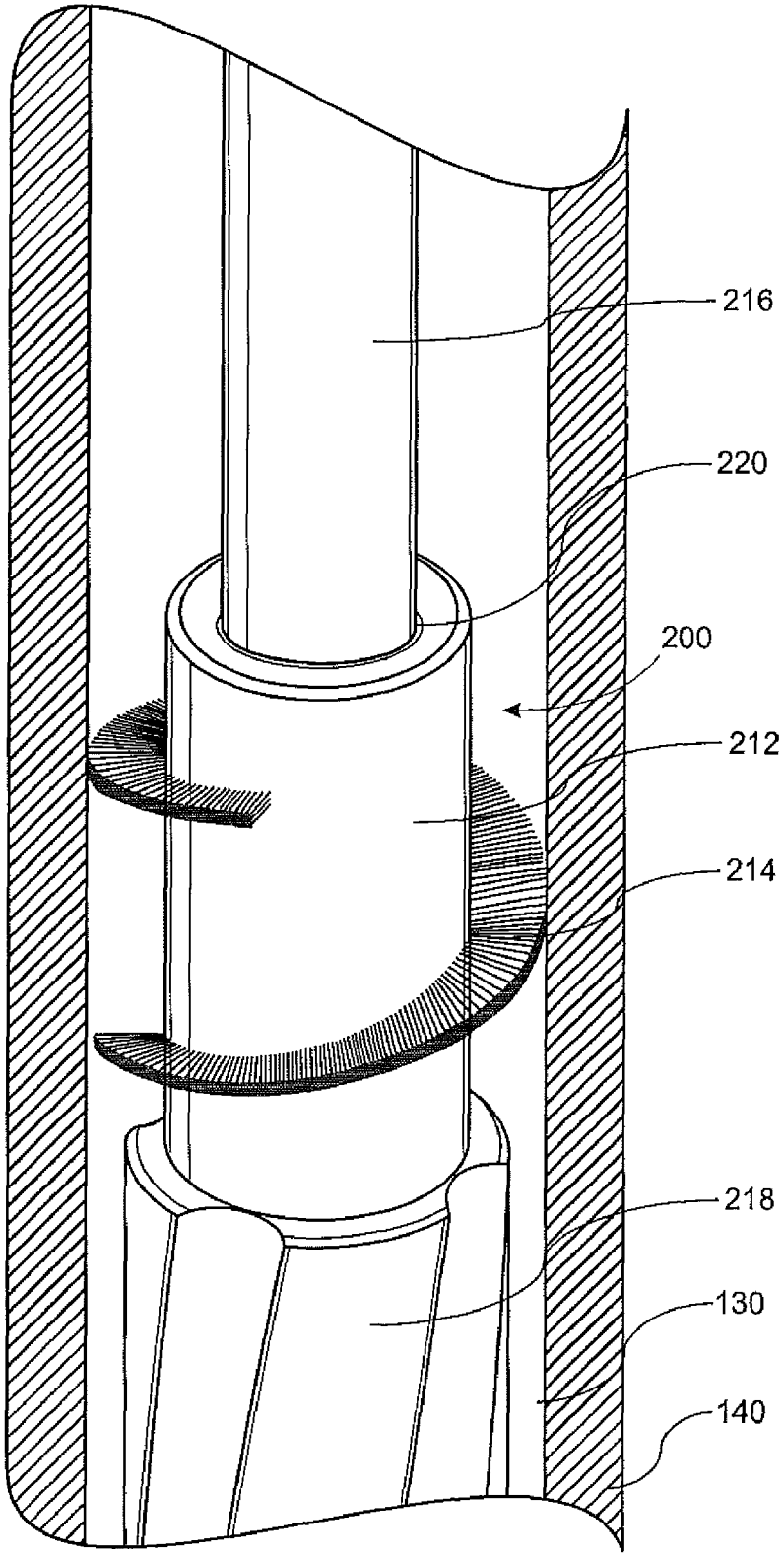
FIG. 6 is a close-up perspective view of the debris-catching attachment device of FIG. 4.

The brushes 214, as shown in this embodiment, extend from an outer portion of the inner ring 212, and are outward-facing. Referring specifically to FIGS. 4-6, in a preferred embodiment, the brushes 214 are in a substantially spiraled configuration, as shown. However, the brushes 214 could be in a substantially flat configuration, such that all the brushes 214 are on the same elevation, as shown in another embodiment in FIGS. 7-9. Further, the brushes 214 could be in a mixed configuration wherein some of the brushes 214 are substantially flat and some of the brushes 214 are substantially spiraled.

With respect to materials used for the brushes 214, they may be comprised of an elastic material, a rubber material, or some other suitable material that is oil-resistant and capable of withstanding acid fluids and conditions present in typical well environments. It may be desired to form the brushes 214 from material that could be in a sheet form and then cut to fit a desired design for the brushes 214 and individual bristles thereon. Individual bristles on the brushes 214 may be shaped in a variety of ways; for example, they may be flat, round, square, and the like.

Figure 7:
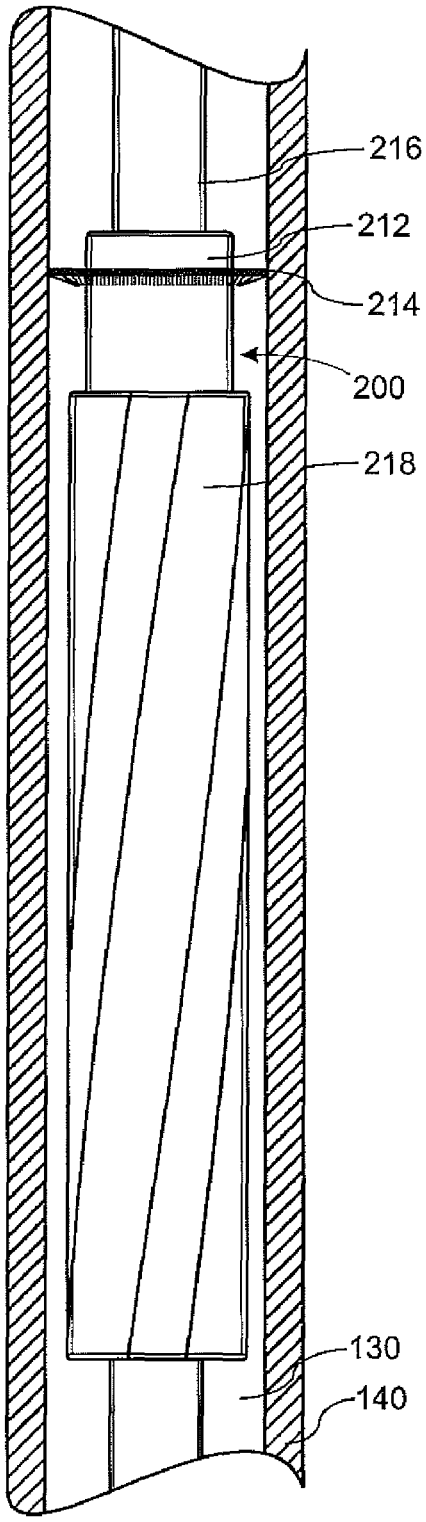
FIG. 7 is a side view of a debris-catching attachment device shown in position on a rod string, consistent with an embodiment of the present invention.
Figure 8:
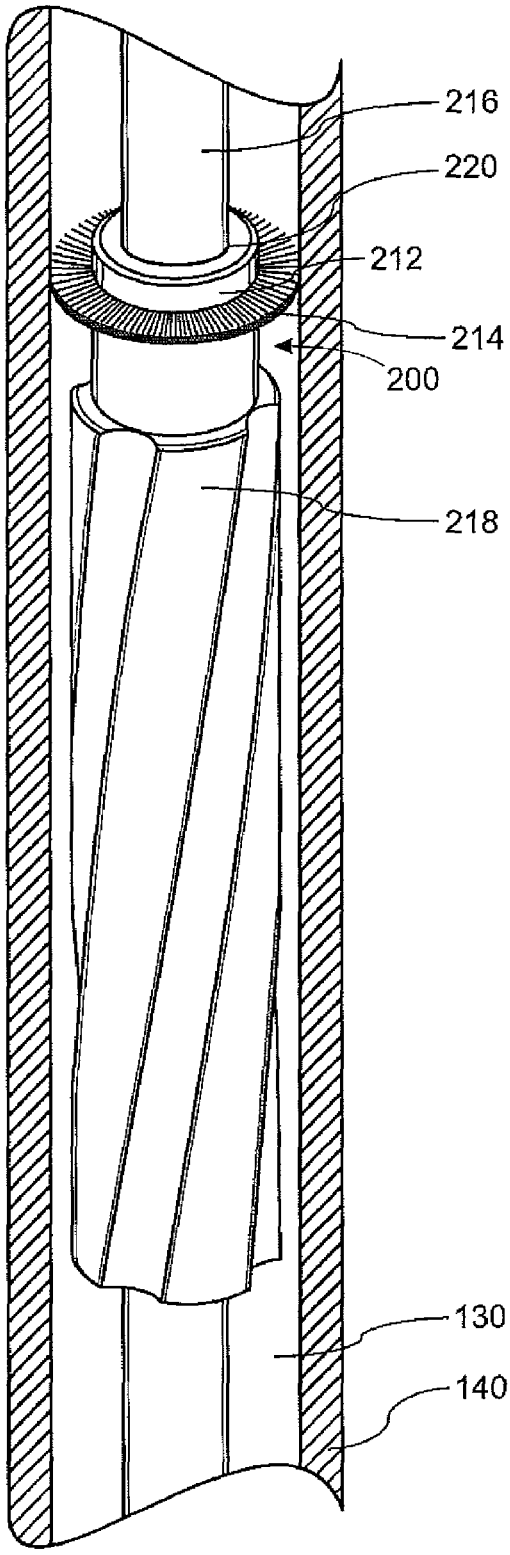
FIG. 8 is a perspective view of the debris-catching attachment device of FIG. 7.
Figure 9:
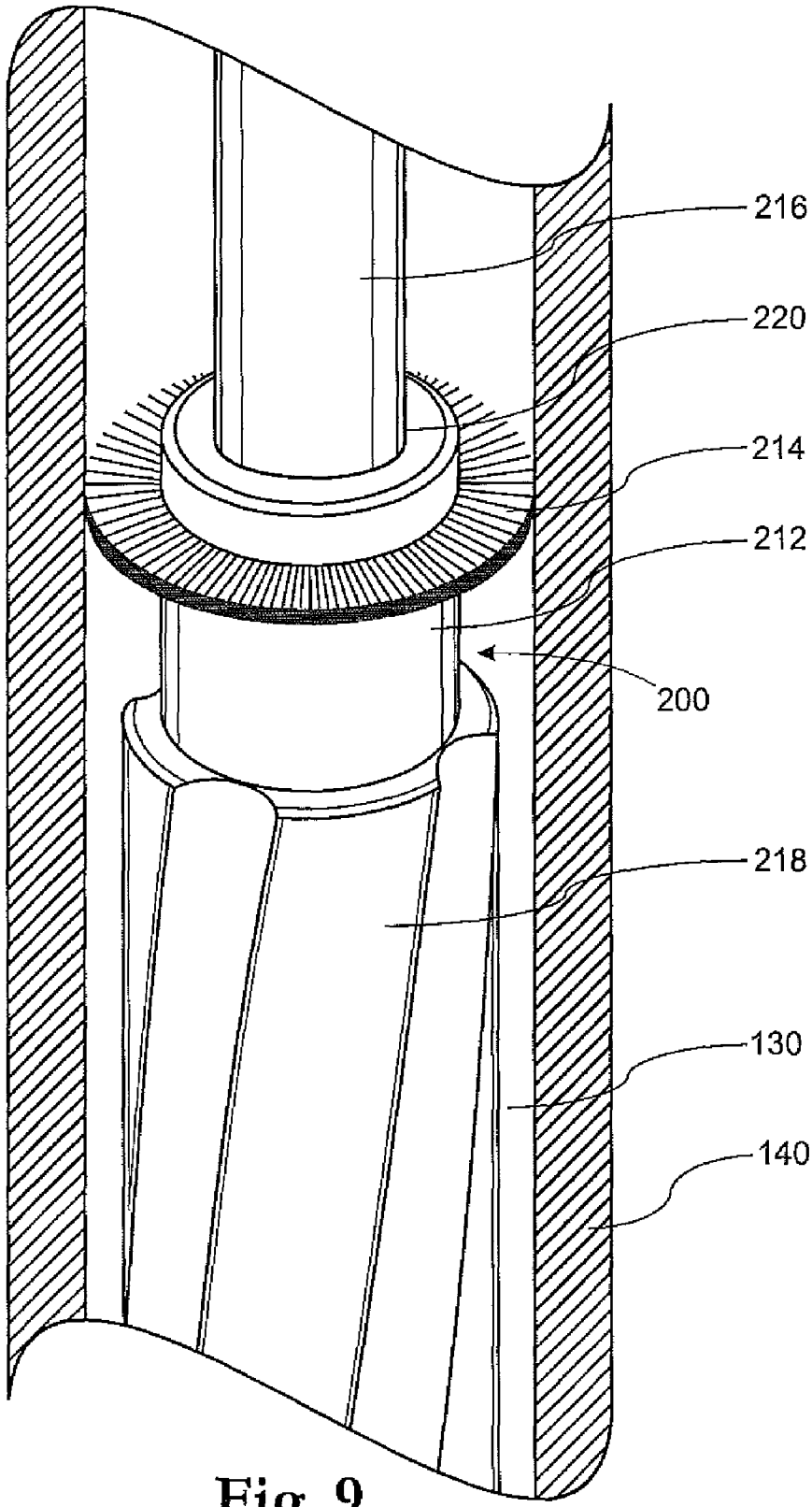
FIG. 9 is a close-up perspective view of the debris-catching attachment device of FIG. 7.

The debris-catching attachment device 200 provides multiple benefits. When positioned on a rod string 216 in a pumping system, the debris-catching attachment device 200 helps in preventing solid impurities, such as sand, pebbles, limestone, and other sediment and debris found in well environments, from settling onto the pump and its components when pumping operations are halted. With the debris-catching attachment device 200 in place, solid impurities will settle on top of the brushes 214. A vertical block for solid impurities is thereby created, but permits the flow of fluid. Also, with the spiraled configuration of the brushes 214 of the embodiment shown in FIGS. 4-6, fluid may channel itself around the brushes 214. As fluid is being pumped upward through the tubing 130, it will make contact with the brushes 214. As this occurs, the spiraled configuration of the brushes 214 causes the fluid to rotate or spin in a cyclonic motion. As the fluid rotates cyclonically, with the solids naturally being heavier than the fluid, the solids will move toward the wall of the tubing 130, allowing any water and oil to move upward to the surface, with the surface tension dragging the solids along the wall of the tubing 130. With the substantially flat configuration of the brushes 214 as shown in FIGS. 7-9, back pressure is created, preventing solid impurities from passing. For both embodiments shown in FIGS. 4-6 and 7-9, it would be possible to create a debris-catching attachment device 200 with multiple levels of brushes 214, which may become necessary based on particular well conditions, such as extreme conditions in well environments in which a high amount of solids is present.

Referring now to FIGS. 10-12, 13-15 and 16-17, additional embodiments of a debris-catching attachment device, hereinafter debris-catching attachment device 230, consistent with an embodiment of the present invention are shown. FIGS. 10-12, 13 and 16-17 show the debris-catching attachment device 230 positioned within tubing 130 in a pump barrel 140. Like the debris-catching attachment device 200, the debris-catching attachment device 230 is adapted to be positioned around a rod string 216. The debris-catching attachment device 230 comprises an inner ring 232 with a plurality of wiper segments 234 coupled thereto. An opening 240 (as shown in FIGS. 11, 12, 15 and 17) in the debris-catching attachment device 230 permits the rod string 216 to pass therethrough, and is preferably adapted to correspond to an opening in a rod guide 218.

The inner ring 232 is preferably comprised of metal or some other durable material capable of withstanding conditions present in typical well environments. Preferably, the inner ring 232 is substantially cylindrical in shape, as shown in this embodiment, but may take on various other shapes. The inner ring 232, as shown in this embodiment, may be adapted to be coupled to a rod guide 218. It may be desired to removably couple the debris-catching attachment device 230 to the rod guide 218 by some suitable means, such as threading. Alternatively, it may be desired to form the rod guide 218 and debris-catching attachment device 230 as a one-piece unit.

Figure 10:
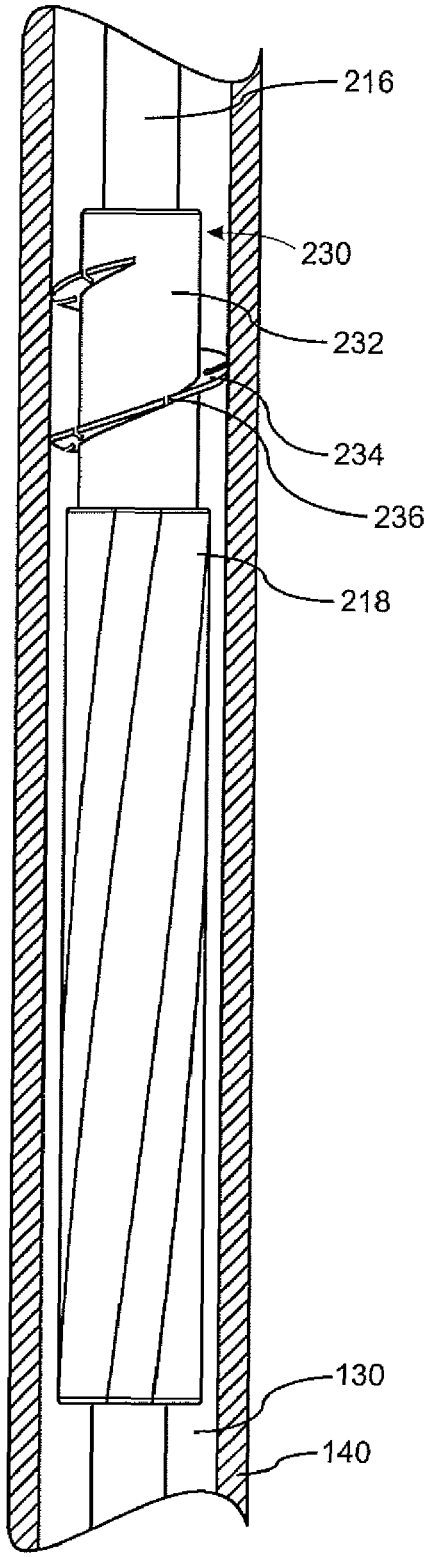
FIG. 10 is a side view of a debris-catching attachment device shown in position on a rod string, consistent with an embodiment of the present invention.
Figure 11:
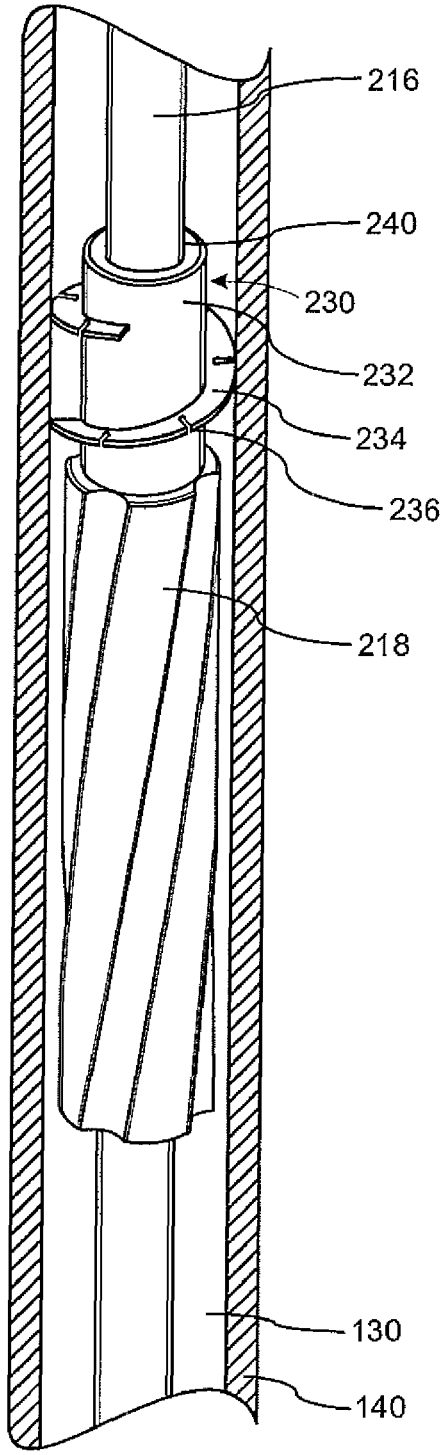
FIG. 11 is a perspective view of the debris-catching attachment device of FIG. 7.
Figure 12:
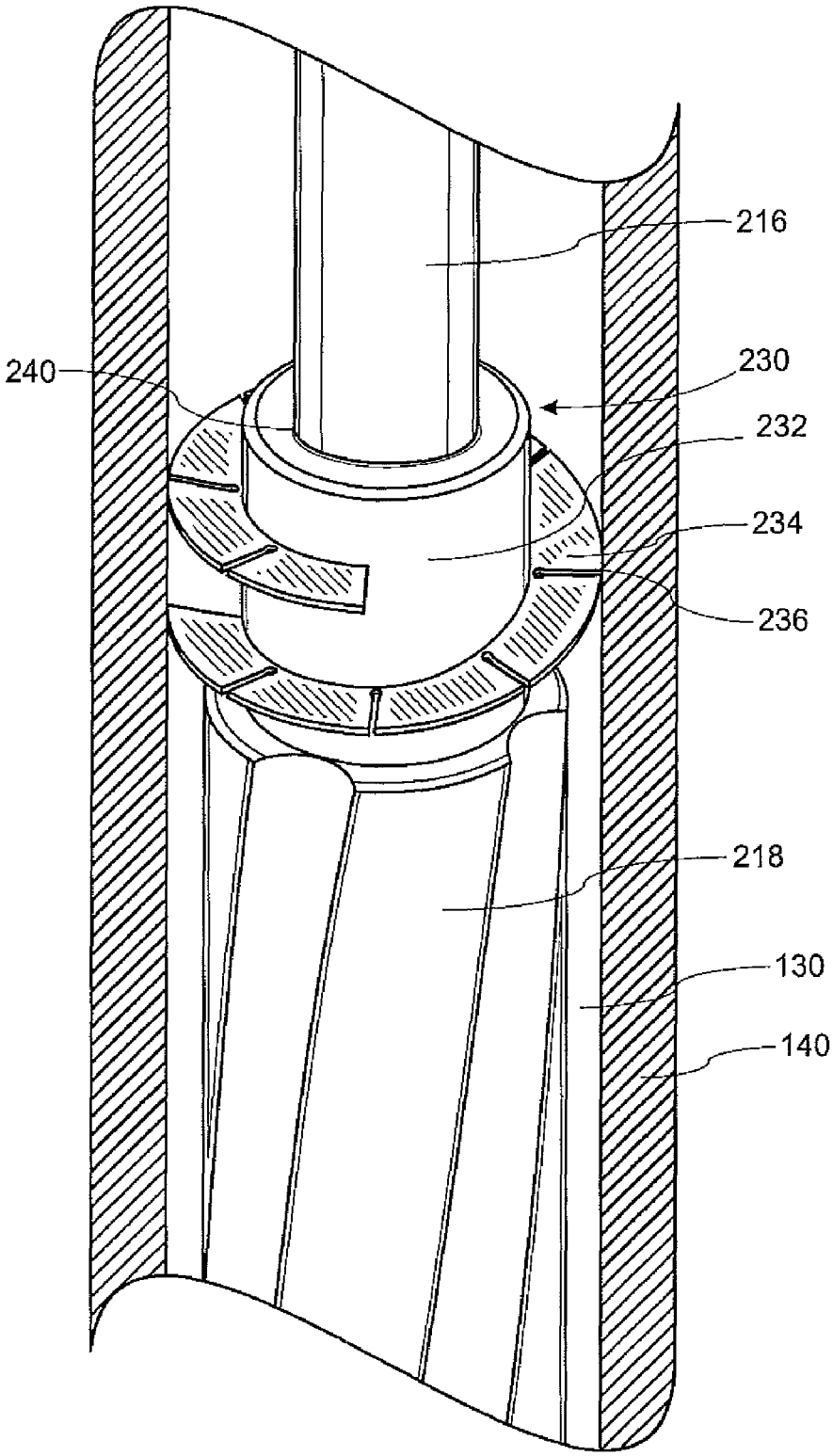
FIG. 12 is a close-up perspective view of the debris-catching attachment device of FIG. 7.
Figure 13:
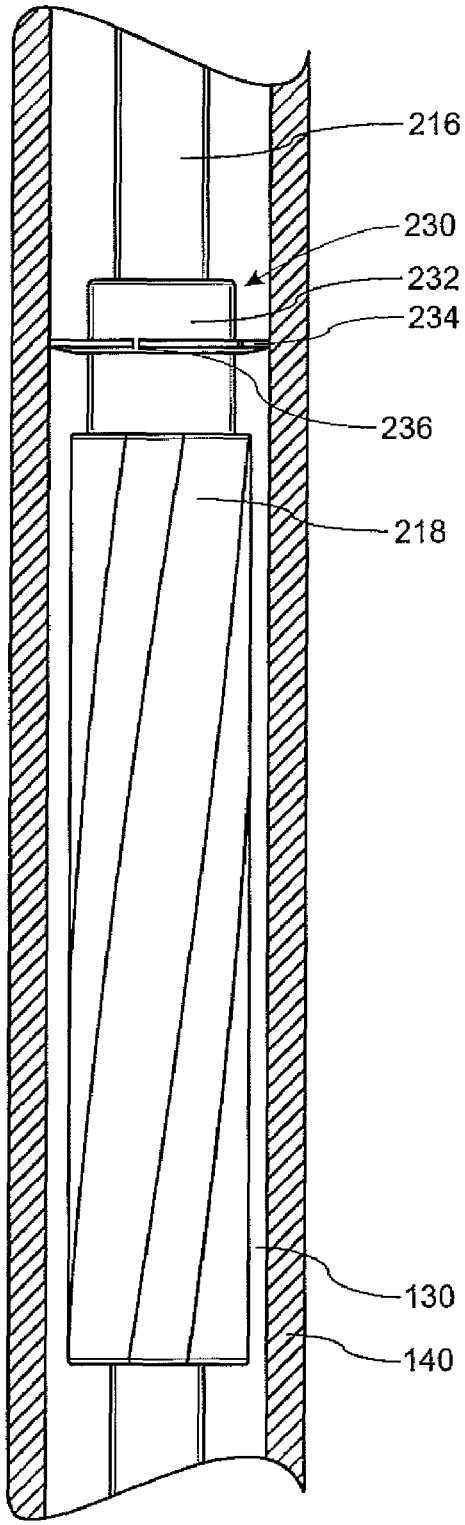
FIG. 13 is a side view of a debris-catching attachment device, consistent with an embodiment of the present invention.
Figure 14:
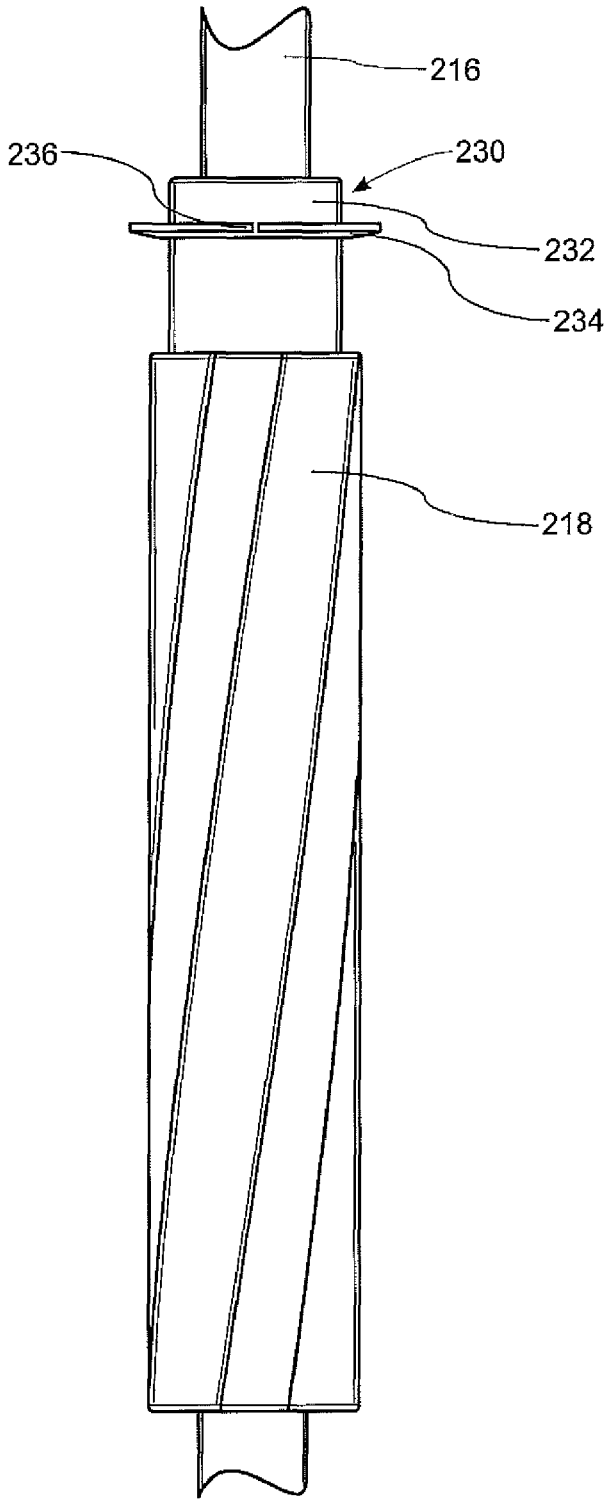
FIG. 14 is a side view of a debris-catching attachment device, consistent with an embodiment of the present invention.
Figure 15:
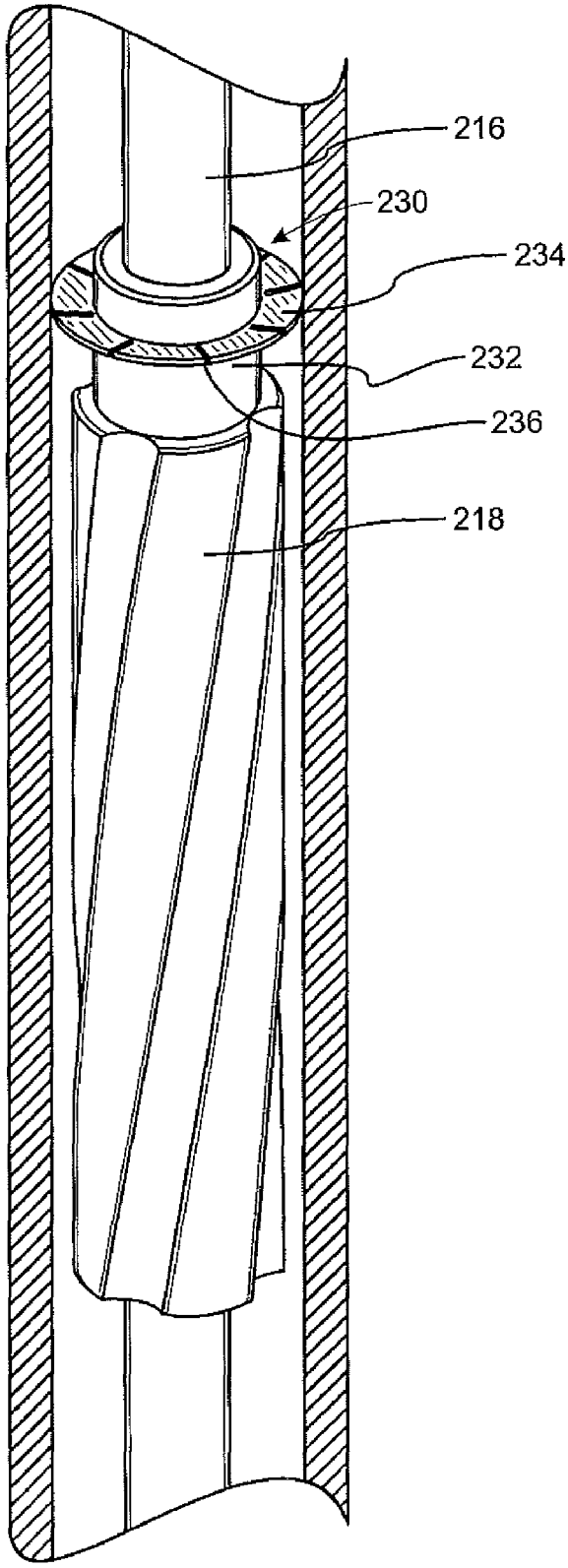
FIG. 15 is a perspective view of the debris-catching attachment device of FIG. 14.

The wiper segments 234, as shown in this embodiment, extend from an outer portion of the inner ring 232, and are outward-facing. Gaps 236 between individual wiper segments 234 assist with fluid flow, as further discussed below. Referring specifically to FIGS. 10-12, in a preferred embodiment, the wiper segments 234 are arranged in a substantially spiraled configuration, as shown. However, in other embodiments, the wiper segments 234 could be arranged in a substantially flat configuration, such that all of the wiper segments 234 are on the same elevation, as shown in the embodiments in FIGS. 13-15 and 16-17. Further, the wiper segments 234 could be in a mixed configuration wherein some of the wiper segments 234 are substantially flat and some of the wiper segments 234 are substantially spiraled. In the embodiments shown in FIGS. 10-12, 13-15 and 16-17, the wiper segments 234 are coupled to each other to form a one-piece unit. However, the wiper segments 234 could be configured as a multiple-piece unit, if desired.

With respect to materials used for the wiper segments 234, they may be comprised of an elastic material, a rubber material, or some other suitable material that is oil-resistant and capable of withstanding acid fluids and conditions present in typical well environments. Instead of wiper segments 234, it may be desired to utilize a flat, wide bristle on the debris-catching device 230. It may be desired to form the wiper segments 234 from material that could be in a sheet form and then cut to fit a desired design for the wiper segments 234. The wiper segments 234 may be shaped in a variety of ways; for example, they may be flat, round, square, and the like. The wiper segments 234 are preferably flexible and capable of moving in both an upward and downward direction.

The debris-catching attachment device 230 provides multiple benefits. When positioned on a rod string 216 in a pumping system, the debris-catching attachment device 230 helps in preventing solid impurities, such as sand, pebbles, limestone, and other sediment and debris found in well environments, from settling onto the pump and its components when pumping operations are halted. With the debris-catching attachment device 230 in place, solid impurities will settle on top of the wiper segments 234. A vertical block for solid impurities is thereby created, but permits the flow of fluid. Also, with the spiraled configuration of the wiper segments 234 of FIGS. 10-12, fluid may channel itself around the wiper segments 234. As fluid is being pumped upward through the tubing 130, it will make contact with the wiper segments 234. As this occurs, the spiraled orientation of the wiper segments 234 causes the fluid to rotate or spin in a cyclonic motion. As the fluid rotates cyclonically, with the solids naturally being heaver than the fluid, the solids will move toward the wall of the tubing 130, allowing any water and oil to move upward to the surface, with the surface tension dragging the solids along the wall of the tubing 130. With the substantially flat configuration of the wiper segments 234 as shown in FIGS. 13-15 and 16-17, back pressure is created, preventing solid impurities from passing. In each of the embodiments shown in FIGS. 10-12, 13-15 and 16-17, as fluid is being pumped, it is also diverted to the gaps 236 between the wiper segments 234.

Figure 16:
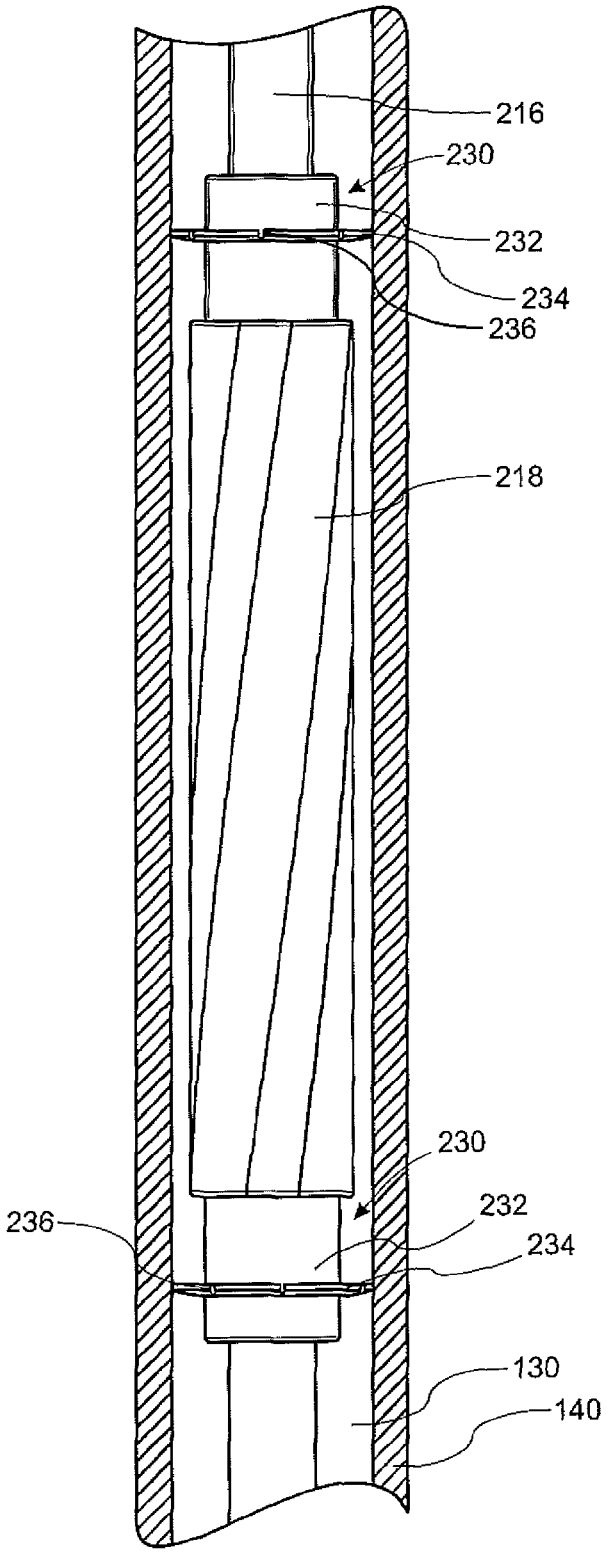
FIG. 16 is a side view of a debris-catching attachment device, consistent with an embodiment of the present invention.
Figure 17:
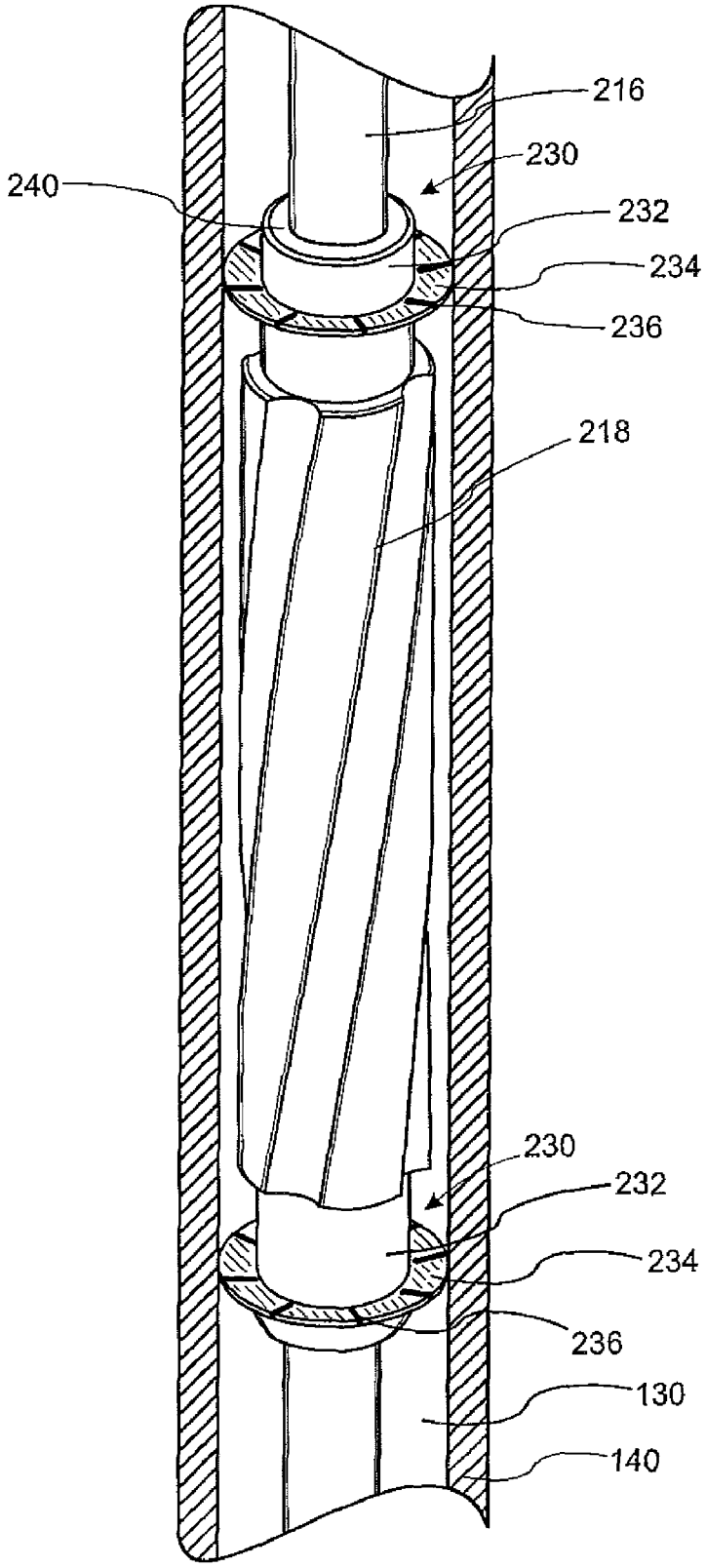
FIG. 17 is a perspective view of the debris-catching attachment device of FIG. 16.

Referring specifically to FIGS. 16-17, multiple debris-catching attachment devices 230 are positioned on a rod string. Utilizing multiple debris-catching attachment devices 230 may be helpful in extreme conditions in well environments in which a high amount of solids is present. Although two debris-catching attachment devices 230 are shown in FIGS. 16-17, it would be possible to utilize more than two such devices, if desired.

Figure 18:
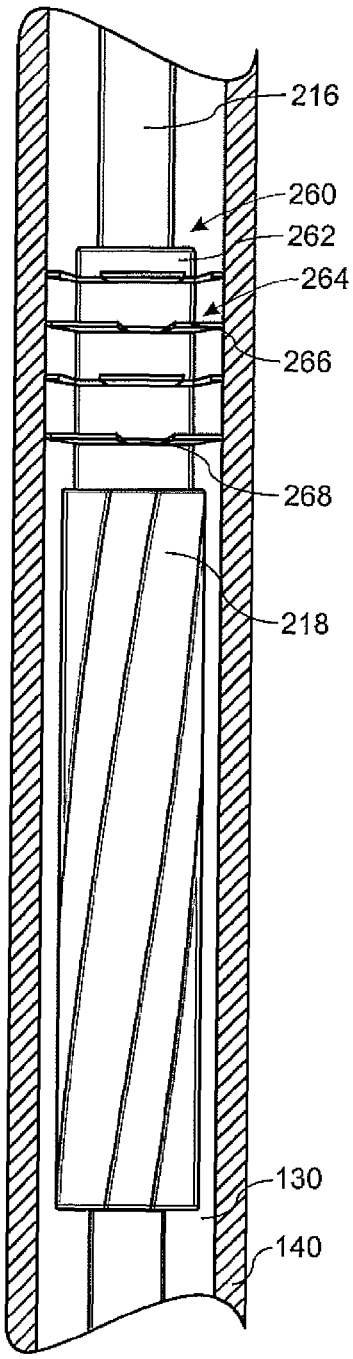
FIG. 18 is a side view of a debris-catching attachment device, consistent with an embodiment of the present invention.
Figure 19:
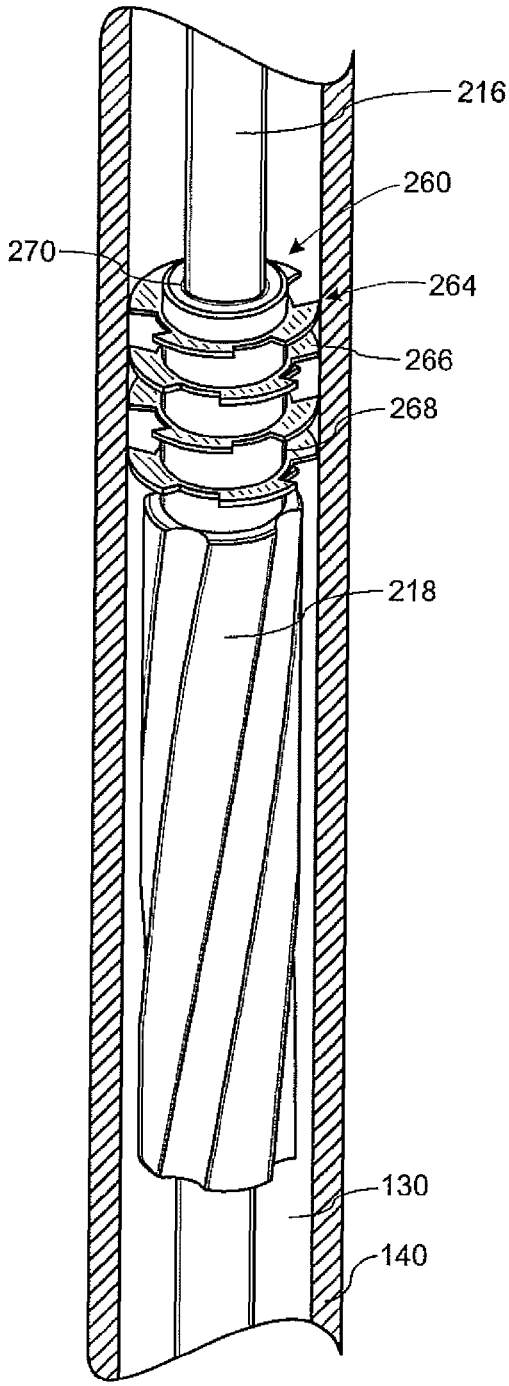
FIG. 19 is a perspective view of the debris-catching attachment device of FIG. 18.
Figure 20:
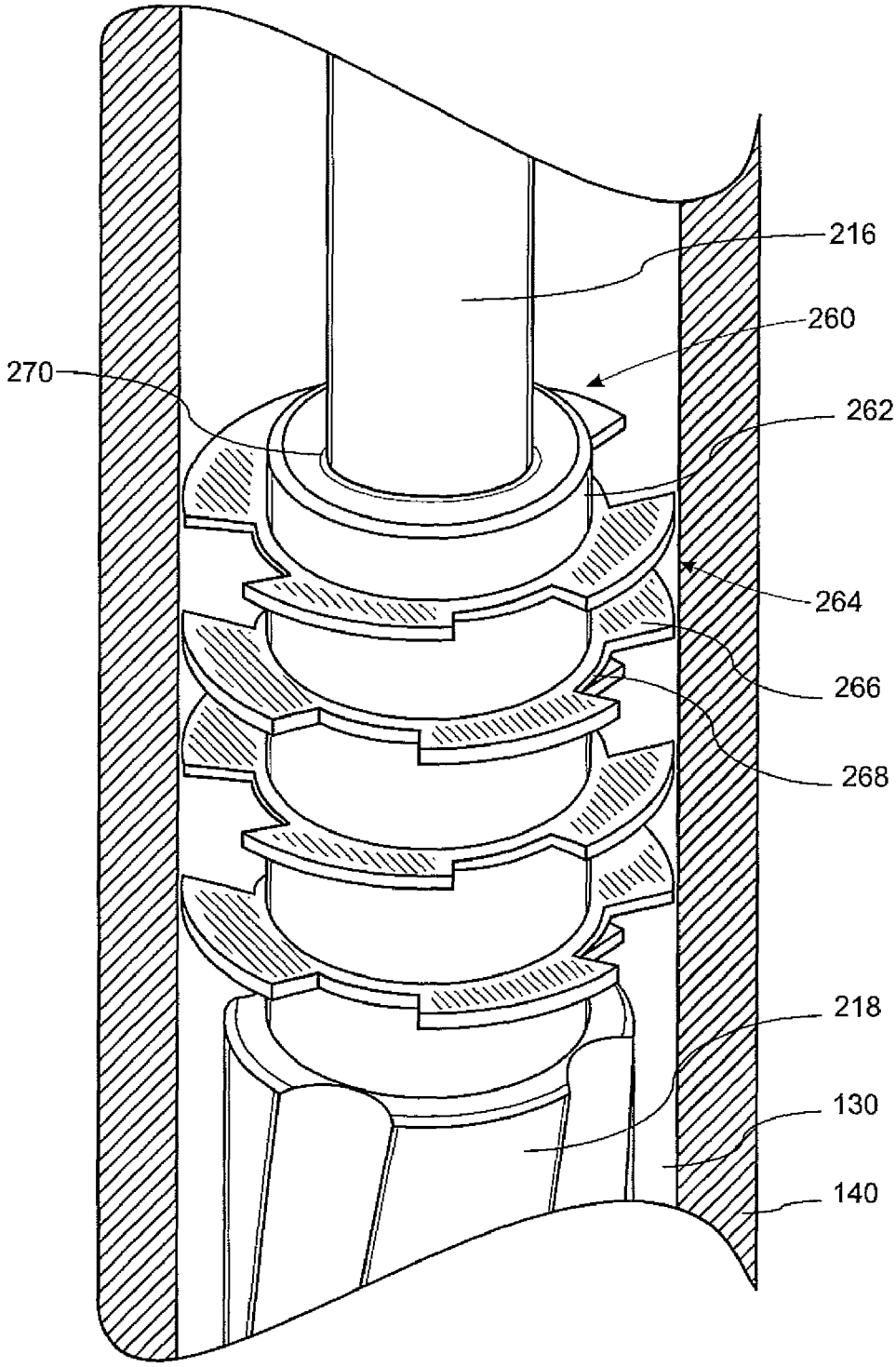
FIG. 20 is a close-up perspective view of the debris-catching attachment device of FIG. 18.
Figure 21:
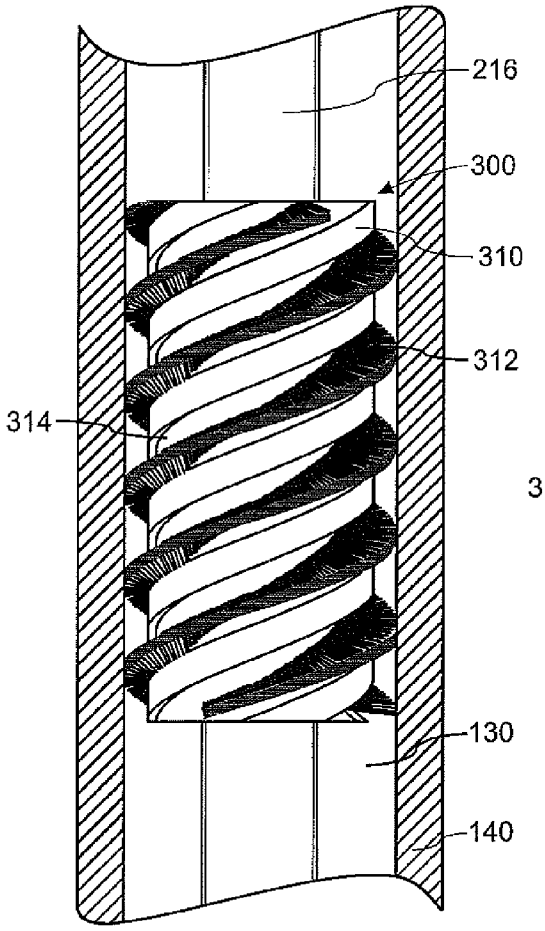
FIG. 21 is a side view of a debris-catching attachment device, consistent with an embodiment of the present invention.
Figure 22:
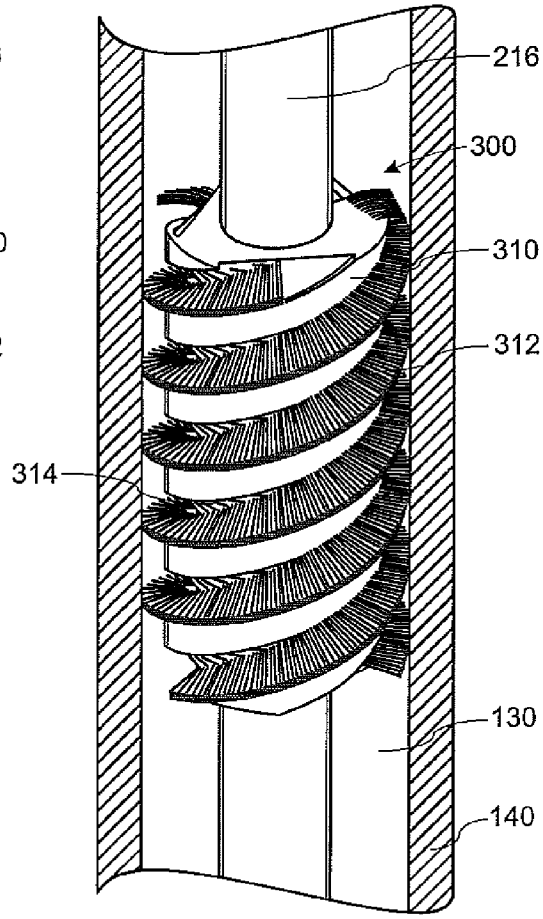
FIG. 22 is a perspective view of the debris-catching attachment device of FIG. 21.
Figure 23:
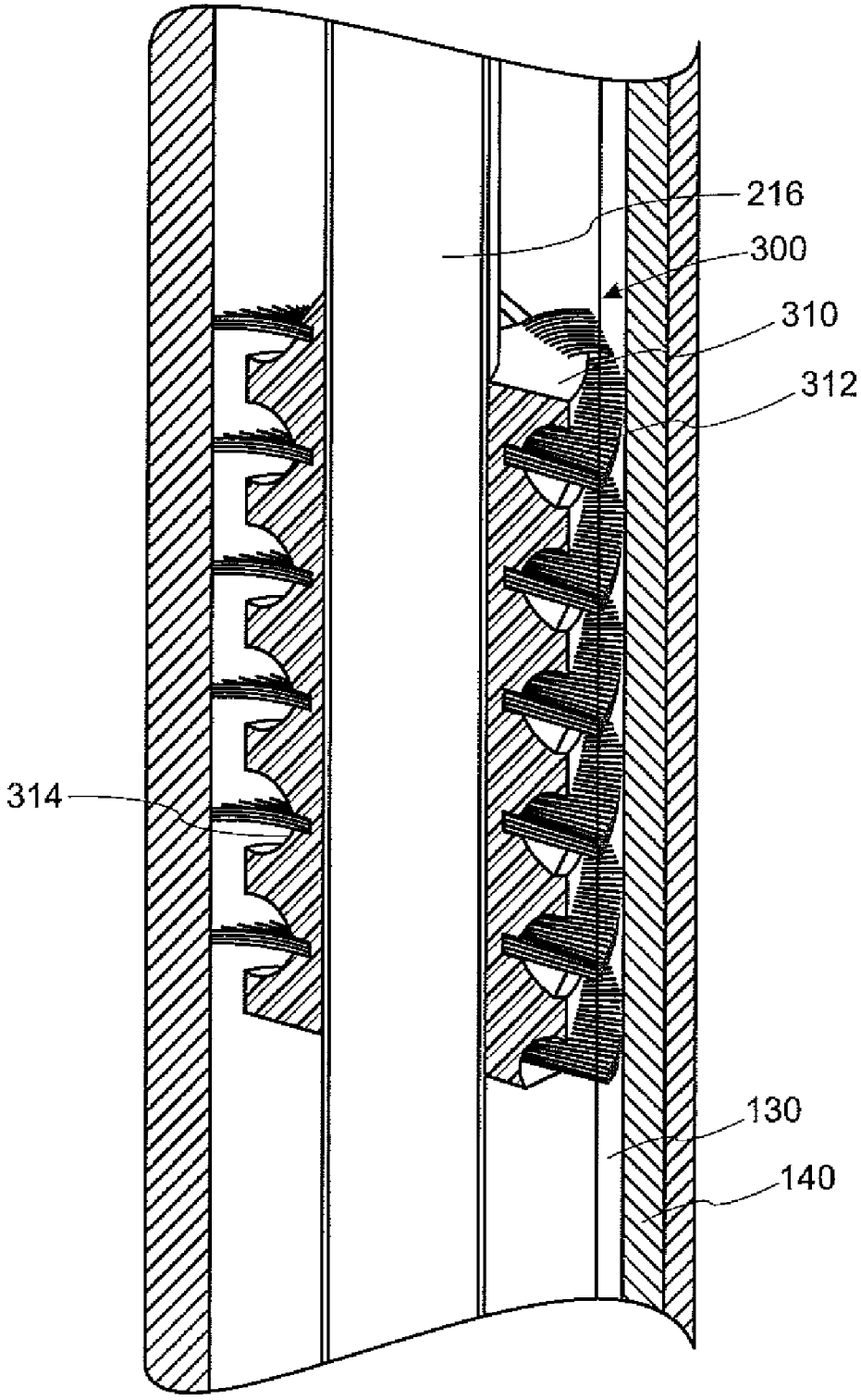
FIG. 23 is a cross-sectional view of the debris-catching attachment device of FIG. 21.

Referring now to FIGS. 18-20, another embodiment of a debris-catching attachment device, hereinafter debris-catching attachment device 260, consistent with an embodiment of the present invention is shown positioned within tubing 130 in a pump barrel 140. Like the debris-catching attachment devices 200 and 230, the debris-catching attachment device 260 is adapted to be positioned around a rod string 216. The debris-catching attachment device 260 comprises an inner ring 262 with a plurality of wiper segments 264 coupled thereto. An opening 270 (as shown in FIGS. 19 and 20) in the debris-catching attachment device 260 permits the rod string 216 to pass therethrough, and is preferably adapted to correspond to an opening in a rod guide 218.

The inner ring 262 is preferably comprised of metal or some other durable material capable of withstanding conditions present in typical well environments. Preferably, the inner ring 262 is substantially cylindrical in shape, as shown in this embodiment, but may take on various other shapes. The inner ring 262, as shown in this embodiment, may be adapted to be coupled to a rod guide 218. It may be desired to removably couple the debris-catching attachment device 260 to the rod guide 218 by some suitable means, such as threading. Alternatively, it may be desired to form the rod guide 218 and debris-catching attachment device 260 as a one-piece unit.

The wiper segments 264, as shown in this embodiment, extend from an outer portion of the inner ring 262, and are outward-facing. In this embodiment, multiple wiper segments 264 are utilized. Each wiper segment 264 preferably includes a plurality of flaps 266 and a plurality of notched-out portions 268. The multiple wiper segments 264 are preferably aligned vertically such that the notched-out portions 266 of a first wiper segment 264 are aligned directly below the flaps 264 of a second wiper segment 264, and so on.

With respect to materials used for the wiper segments 264, they may be comprised of an elastic material, a rubber material, or some other suitable material that is oil-resistant and capable of withstanding acid fluids and conditions present in typical well environments. It may be desired to form the wiper segments 264 from material that could be in a sheet form and then cut to fit a desired design for the wiper segments 264. The wiper segments 264 may be shaped in a variety of ways; for example, they may be flat, round, square, and the like. The wiper segments 264 are preferably flexible and capable of moving in both an upward and downward direction.

When positioned on a rod string in a pumping system, the debris-catching attachment device 260 helps in preventing solid impurities, such as sand, pebbles, limestone, and other sediment and debris found in well environments, from settling onto the pump and its components when pumping operations are halted. With the debris-catching attachment device 260 in place, solid impurities will settle on top of the wiper segments 264. A vertical block for solid impurities is thereby created, but permits the flow of fluid through the notched-out portions 266 of the wiper segments 264. As with the debris-catching attachment device 230, it may be desired to utilize multiple debris-catching attachment devices 260 and position them on a rod string 216 in similar fashion to the embodiments shown in FIGS. 16 and 17.

Figure 24:
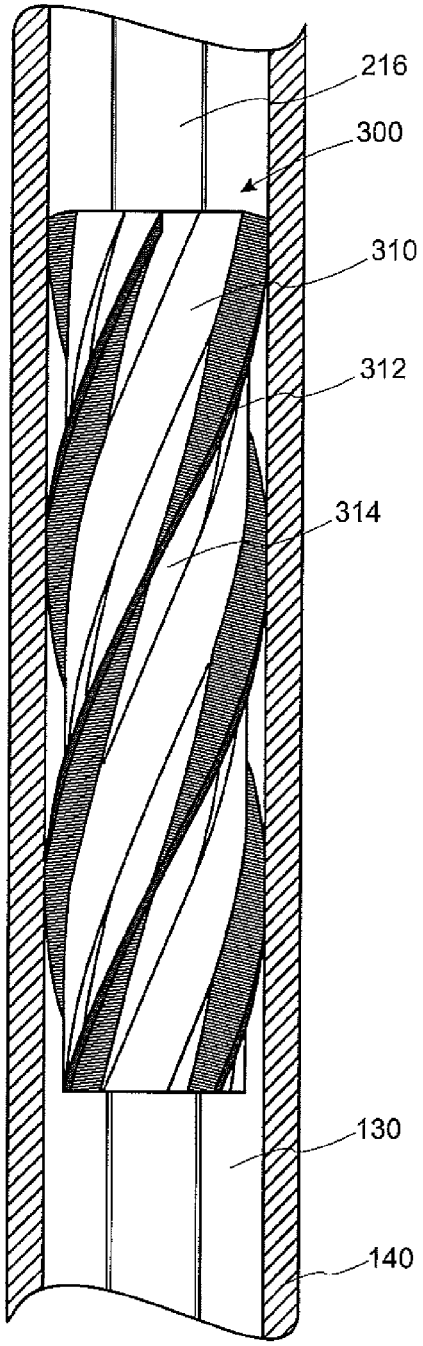
FIG. 24 is a side view of a debris-catching attachment device, consistent with an embodiment of the present invention.
Figure 25:
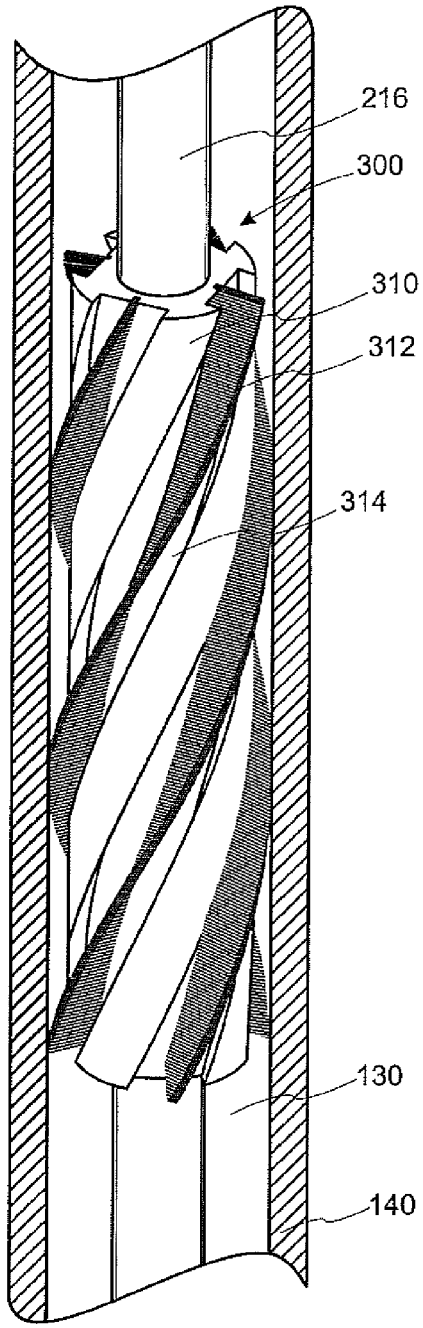
FIG. 25 is a perspective view of the debris-catching attachment device of FIG. 24.

Referring now to FIGS. 21-23 and 24-25, further embodiments of a debris-catching attachment device, hereinafter debris-catching attachment device 300, consistent with an embodiment of the present invention are shown positioned within tubing 130 in a pump barrel 140. The debris-catching attachment device 300 is adapted to be positioned around a rod string 216, and is configured as a rod guide. The debris-catching attachment device 300 comprises a rod guide 310 with a plurality of brushes 312 coupled thereto. In this embodiment, the brushes 312 are positioned in a plurality of spiral fluid grooves 314 in the rod guide 310. An opening 316 in the debris-catching attachment device 300 permits the rod string 216 to pass therethrough. FIGS. 24-25 illustrate an embodiment of the debris-catching attachment device 300 in which the grooves 314 (and, correspondingly, the brushes 312) are positioned on the rod guide 310 at a steeper angle as compared to the embodiment of FIGS. 21-23.

The debris-catching attachment device 300 may be affixed firmly to the rod string 216. Alternatively, the debris-catching attachment device 300 may be loosely affixed, so that the rod guide 310 may rotate as fluid passes through the grooves 314, thus performing an additional benefit of cleaning the wall of the tubing 130.

With respect to materials used for the brushes 312, they may be comprised of an elastic material, a rubber material, or some other suitable material that is oil-resistant and capable of withstanding acid fluids and conditions present in typical well environments. It may be desired to form the brushes 312 from material that could be in a sheet form and then cut to fit a desired design for the brushes 312 and individual bristles thereon. Individual bristles on the brushes 312 may be shaped in a variety of ways; for example, they may be flat, round, square, and the like.

The debris-catching attachment device 300 provides multiple benefits. When positioned on a rod string in a pumping system, the debris-catching attachment device 300 helps in preventing solid impurities, such as sand, pebbles, limestone, and other sediment and debris found in well environments, from settling onto the pump and its components when pumping operations are halted. With the debris-catching attachment device 300 in place, solid impurities will settle on top of the brushes 312. A vertical block for solid impurities is thereby created, but permits the flow of fluid. Also, with the spiraled configuration of the brushes 312, fluid may channel itself around the brushes 312. As fluid is being pumped upward through the tubing 130, it will make contact with the brushes 312. As this occurs, the spiral orientation of the brushes 312 causes the fluid to rotate or spin in a cyclonic motion. As the fluid rotates cyclonically, with the solids naturally being heavier than the fluid, the solids will move toward the wall of the tubing 130, allowing any water and oil to move upward to the surface, with the surface tension dragging the solids along the wall of the tubing 130. The angle of the grooves 314 and brushes 312 of the debris-catching attachment device 300 may be varied, in order to accommodate various viscosities of crude and amounts of solid impurities that may be found in the fluid that is being pumped. With crude having relatively lower viscosities, it is preferred to utilize a debris-catching attachment device 300 in which the grooves 314 are relatively less steep, in that fluid will pass more easily, while solid impurities will still be blocked by the brushes 312.

While the invention has been particularly shown and described with reference to preferred embodiments thereof, it will be understood by those skilled in the art that the foregoing and other changes in form and details may be made therein without departing from the spirit and scope of the invention.

I claim:

1. A debris-catching attachment device comprising, in combination:

a ring positioned within a tubing of a pumping system and adapted to permit a rod string to pass through a portion thereof; and one of a plurality of brushes and a plurality of wiper segments attached to an inner surface of the ring and positioned within the tubing;

wherein the one of a plurality of brushes and a plurality of wiper segments are positioned in a substantially spiraled configuration.

2. The debris-catching attachment device of claim 1 wherein the ring is configured as a rod guide.

3. The debris-catching attachment device of claim 1 wherein the one of a plurality of brushes and a plurality of wiper segments are positioned in a mixed configuration wherein a first portion of the one of a plurality of brushes and a plurality of wiper segments is positioned in a substantially flat configuration and a second portion of the one of a plurality of brushes and a plurality of wiper segments is positioned in a substantially spiraled configuration.

4. A debris-catching attachment device comprising, in combination:

a ring adapted to permit a rod string to pass through a central portion thereof; and one of a plurality of brushes and a plurality of wiper segments coupled to a surface of the ring;

wherein the debris-catching attachment device is adapted to be positioned within tubing of a pumping system;

wherein the one of a plurality of brushes and a plurality of wiper segments are coupled to an inner surface of the ring are positioned in a substantially spiraled configuration.

5. The debris-catching attachment device of claim 4 wherein the one of a plurality of brushes and a plurality of wiper segments are positioned in a mixed configuration wherein a first portion of the one of a plurality of brushes and a plurality of wiper segments is positioned in a substantially flat configuration and a second portion of the one of a plurality of brushes and a plurality of wiper segments is positioned in a substantially spiraled configuration.

6. The debris-catching attachment device of claim 4, wherein the plurality of wiper segments define gaps therebetween.

7. A method for directing fluid through wellbore tubing comprising the steps of:

providing at least one debris-catching attachment device comprising, in combination:

a ring adapted to permit a rod string to pass through a central portion thereof; and one of a plurality of brushes and a plurality of wiper segments coupled to a surface of the ring, wherein the one of a plurality of brushes and a plurality of wiper segments are positioned in a substantially spiraled configuration;

wherein the debris-catching attachment device is adapted to be positioned within the tubing;

positioning the debris-catching attachment device within the tubing;

forcing fluid upward;

wherein the fluid flows past the one of a plurality of brushes and plurality of wiper segments;

directing the fluid toward a wall of the tubing; and causing solid impurities entrained in the fluid to accumulate on the one of a plurality of brushes and plurality of wiper segments.

8. The method of claim 7 further comprising positioning a plurality of debris-catching attachment devices within the tubing.

9. The method of claim 7 further comprising the step of utilizing a pumping system to force the fluid upward.

10. The method of claim 9 further comprising the step of positioning the debris-catching attachment device proximate a rod guide of the pumping system.

* * * * *